US005805453A

United States Patent [19]

Sasaki

[11] Patent Number: 5,805,453

[45] Date of Patent: Sep. 8, 1998

[54] SYSTEM IDENTIFIER FOR PAPER MACHINE

[75] Inventor: Takashi Sasaki, Tokyo, Japan

[73] Assignee: Yokogawa Electric Corporation, Tokyo, Japan

[21] Appl. No.: 717,867

[22] Filed: Sep. 23, 1996

[30] Foreign Application Priority Data

Jul. 12, 1996 [JP] Japan ..... 8-183395

[51] Int. Cl.[6] ..... G06F 19/00; G06G 7/64; G06G 7/66

[52] U.S. Cl. ..... 364/471.02; 162/253; 395/900; 395/904; 395/906

[58] Field of Search ..... 364/471.02, 161; 395/3, 900, 904, 906; 162/253

[56] References Cited

U.S. PATENT DOCUMENTS 5,170,357 12/1992 Sasaki et al. ..... 364/471
5,245,528 9/1993 Saito et al. ..... 364/161
5,446,826 8/1995 Otsuki ..... 395/3

OTHER PUBLICATIONS

Tim Mores, Artificial Intelligence, Paper, 35–36, 1993.

*Primary Examiner*—Reba I. Elmore
*Assistant Examiner*—Monica Lewis
*Attorney, Agent, or Firm*—Moonray Kojima

[57] ABSTRACT

A system identifier for a paper machine which allows an operator having no special skills to easily implement step responses in a profile control and which comprises a mechanism for storing theoretical positional correspondence determined by paper contraction; calculator device for calculating profiles for slices associated with the operated ends using measured values at the detected end; another calculating device for calculating the conformity of each operated end by multiplying the profile for the slice by an interference coefficient indicating the effect of an operation on an operated end and on the detected end; an output slice selection device to which data of the conformity of each operated end is inputted and which outputs an output slice selection function by performing a neural network calculation wherein self feedback is performed for the operated end and lateral inhibition is performed to inhibit mutual interference between neighboring operated ends within a predetermined range; and a step response output device for performing step response at the operated ends which have survived within the range in which the mutual interference is inhibited using the output slice selection function.

10 Claims, 23 Drawing Sheets

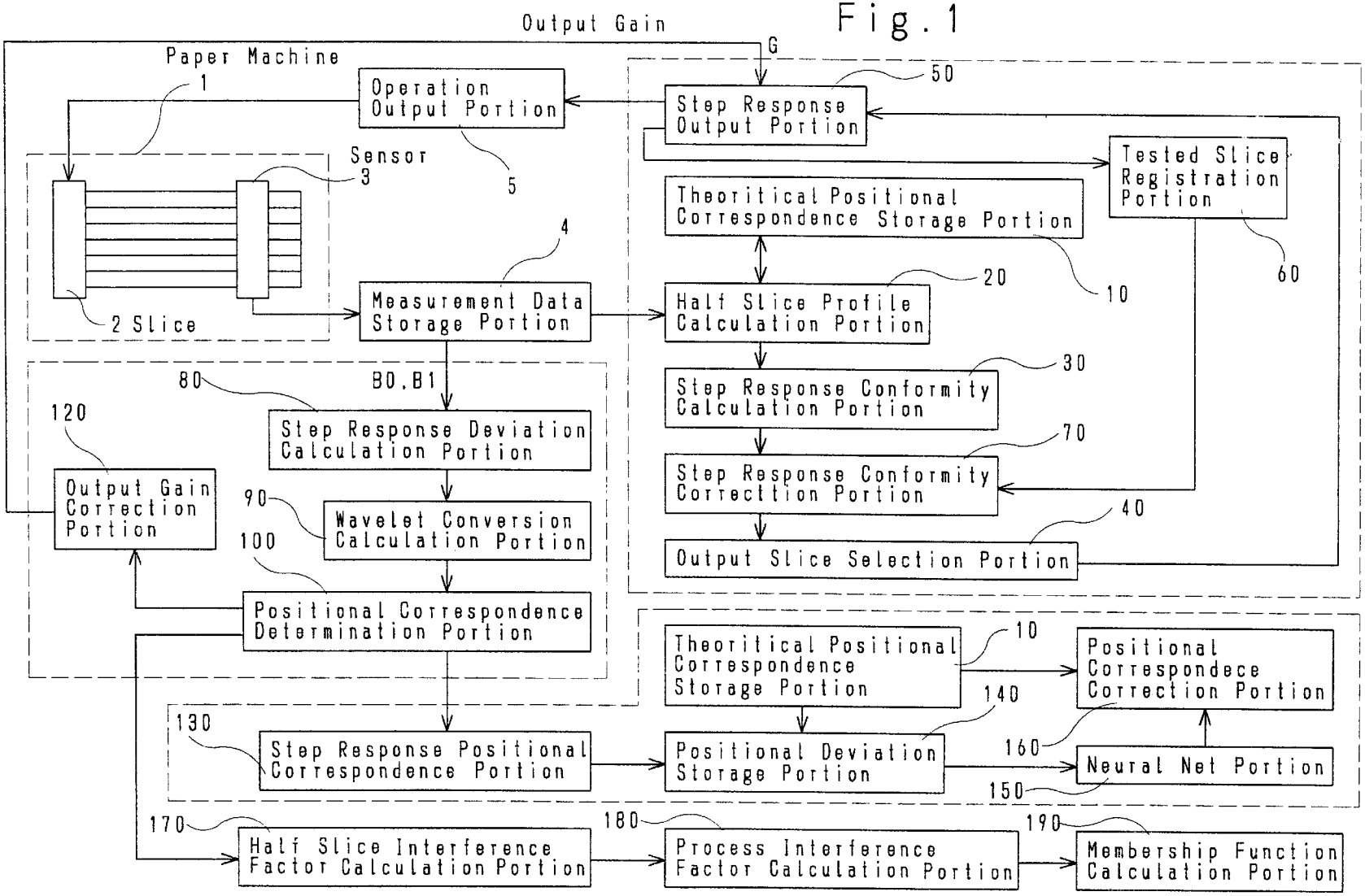
Fig. 1
Step Response Output Portion
Theoritical Positional Correspondence Storage Portion
Tested Slice Registration Portion
Half Slice Profile Calculation Portion
Step Response Conformity Calculation Portion
Step Response Conformity Correction Portion
Output Slice Selection Portion
Theoritical Positional Correspondence Storage Portion
Positional Correspondence Correction Portion
Neural Net Portion
Membership Function Calculation Portion
Positional Deviation Storage Portion
Process Interference Factor Calculation Portion
Operation Output Portion
Measurement Data Storage Portion
B0, B1
Step Response Deviation Calculation Portion
Wavelet Conversion Calculation Portion
Positional Correspondence Determination Portion
Step Response Positional Correspondence Portion
Half Slice Interference Factor Calculation Portion
Output Gain Correction Portion
Sensor
2 Slice
Paper Machine
Output Gain
G
1
3
4
5
10
20
30
40
50
60
70
80
90
100
120
130
140
150
160
170
180
190

$$h_{m,n}(x) = \frac{1}{\sqrt{m}}\, h\left(\frac{x-n}{m}\right)$$

FIRST TIME 15:29:11

LAST TIME 15:39:08 BMAX=1.941 PEAK POS=327

| PPS No. | P(312) | P(317) | P(322) | P(327) | P(332) | P(337) | PP(342) |
|---|---|---|---|---|---|---|---|
| Interference Coefficient | 0.058 | 0.142 | 0.195 | 0.213 | 0.195 | 0.142 | 0.058 |

Positional Correspondence Analysis Program

SLICE 13

FIRST TIME 15:29:11

LAST TIME 15:39:08 BMAX=0.952 PEAK=249

| PPS No. | P(234) | P(239) | P(244) | P(249) | P(254) | P(259) | P(264) |
|---|---|---|---|---|---|---|---|
| Interference Coefficient | -0.003 | 0.249 | 0.175 | 0.147 | 0.175 | 0.249 | -0.003 |

Fig. 21

| Slice No. i | $P_1(i)$ | $P_2(i)$ | $H(i)$ | $Y(i)$ | $P_3(i)$ |
|---|---|---|---|---|---|
| 1 | 359 | | | 0 | 359 |
| 2 | 356 | | | 3 | 359 |
| 3 | 346 | 350 | 4 | 5 | 351 |
| 4 | 336 | | | 5 | 341 |
| 5 | 326 | 330 | 4 | 4 | 330 |
| 6 | 316 | | | 4 | 320 |
| 7 | 306 | 312 | 6 | 4 | 310 |
| 8 | 296 | | | 3 | 299 |
| 9 | 285 | | | 3 | 288 |
| 10 | 275 | | | 2 | 277 |
| 11 | 265 | | | 1 | 266 |
| 12 | 255 | 254 | −1 | 1 | 256 |
| 13 | 245 | | | 0 | 245 |
| 14 | 235 | | | 0 | 235 |
| 15 | 225 | 223 | −2 | −1 | 224 |
| 16 | 215 | | | −1 | 214 |
| 17 | 205 | 206 | 1 | −2 | 203 |
| 18 | 195 | | | −2 | 193 |
| 19 | 185 | | | −3 | 182 |
| 20 | 174 | | | −3 | 171 |
| 21 | 164 | 160 | −4 | −3 | 161 |
| 22 | 154 | | | −4 | 150 |
| 23 | 144 | | | −4 | 140 |
| 24 | 134 | 130 | −4 | −4 | 130 |
| 25 | 124 | | | −4 | 120 |
| 26 | 114 | 109 | −5 | −4 | 110 |
| 27 | 104 | | | −4 | 100 |
| 28 | 94 | | | −4 | 90 |
| 29 | 84 | 80 | −4 | −4 | 80 |
| 30 | 74 | | | −4 | 70 |
| 31 | 63 | 60 | −3 | −4 | 59 |
| 32 | 53 | | | −4 | 49 |
| 33 | 43 | 39 | −4 | −3 | 40 |
| 34 | 33 | 30 | −3 | −3 | 30 |
| 35 | 23 | | | −3 | 20 |
| 36 | 13 | | | −3 | 10 |
| 37 | 3 | | | −3 | 0 |
| 38 | 0 | | | 0 | 0 |

Fig. 25

$WT(m.Nk): k=1,2,---,r$

180 Process Interference Coefficient Calculation Portion $$WTAB(m)=\max\left(\frac{1}{r}\cdot\left(\sum_{k=1}^{r}WT(M.Nk)\right),0\right)$$

$$WTS=\sum_{m=-4}^{+4}WTAB(m)$$

$$WTA(m)=\frac{WTAB(m)}{WTS}$$

190 Membership Function Calculation Portion

Operational Rule 1 Calculation Portion 191

Rule 1 Membership Function

If $WTA(m)\cdot x+1>0.\ F1.m(x)=4\cdot Log(WAT(m))\cdot x+1)$

If $WTA(m)\cdot x+1\leq 0.\ F1.m(x)=-100$

192 Operational Rule 2 Calculation Portion

Rule 2 Membership Function

If $\frac{(WTA(m-1)+WTA(m+1))\cdot x}{0.6\cdot abs(m)+1}+1>0.F2.m(x)=\frac{4}{1.3}\cdot\log\left(\frac{(WTA(m-1)+WTA(m+1))\cdot x}{0.6\cdot abs(m)+1}+1\right)$ If $\frac{(WTA(m-1)+WTA(m+1))\cdot x}{0.6\cdot abs(m)+1}+1\leq 0.F2.m(x)=-100$ 193 Operational Rule 3 Calculation Portion Rule 3 Membership Function When $m=0$ If $\frac{WTA(m)\cdot abs(x)}{5}+1>0.F3.m(x)=\frac{4}{0.9}\cdot\log\left(\frac{WTA(m)\cdot abs(x)}{5}+1\right)$ If $\frac{WTA(m)\cdot abs(x)}{5}+1\leq 0.F3.m(x)=-100$ When $m\neq 0$ If $\frac{WTA(m+1)-WTA(m-1)\cdot x}{0.6\cdot abs(m)+1}+1>0.F3.m(x)=\frac{4}{0.9}\cdot\log\left(\frac{WTA(m+1)-WTA(m-1)\cdot x}{0.6\cdot abs(m)+1}+1\right)$ If $\frac{WTA(m+1)-WTA(m-1)\cdot x}{0.6\cdot abs(m)+1}+1>0.F3.m(x)=-100$

SYSTEM IDENTIFIER FOR PAPER MACHINE

BACKGROUND OF THE INVENTION

1. Field of Invention

This invention relates to a system identifier for a paper machine to provide profile control; and more particularly, to improvements therein, such as for determining positional correspondence to identify measuring points where the effects of operation on a particular slice appears.

2. Description of Related Art

Machinery for producing paper (also called "paper machine" in the art) of a desired weight and thickness by operating a plurality of slicing devices (also called "slice or slices" in the art) disposed in the direction of the width of the paper are known. If positional correspondence, between points where the quality of paper is measured and the slices, are clearly identified, a shortage of weight at a particular position can be easily compensated for by operating the slice associated therewith. Japanese unexamined patent H4-18187 discloses a technique for identifing the positional correspondence between individual slices and positions for measurement by using sensors.

Since a manufacturer must deliver the paper machine controller to a customer with optimized profile control, step responses that clearly identify such positional correspondence are important. Specifically, for slices $N_1, N_2, \ldots, N_r$ from which step responses have been obtained by detecting peak positions, measuring points $P2(N_1)$, $P2(N_2)$, . . . , $P2(N_r)$ in positional correspondence therewith are experimentally identified. In most cases, such step responses are obtained for one third or one half of the total number (NS) of the slices. Such step responses are based on output commands for individual operated ends provided by an engineer through a CRT with the profile being monitored on the CRT.

However, such identification of positional correspondence using step responses involves the following considerations:

(1) The slices to be operated are individually and specifically identified by step responses during a first cycle. In most cases, step responses are obtained for one third or one half of the total number (NS) of slices. However, in order to prevent the step responses from interfering with each other, some amount of interval must be maintained between the operated ends which provide outputs at the same time. This results in a need to reduce the total number of step responses by properly selecting the slices to be operated during the obtaining of the step responses. Furthermore, the trend is now toward using larger and larger paper machines with smaller operated ends so that paper machines are now used having one hundred or more operated ends. This significantly increases the time required for providing step responses, which puts an increased burden on the operator and on the paper manufacturer.

(2) The correspondence of each slice to a measuring point is identified from concavoconvex patterns which appear on a sensor when the slice is operated. As disclosed in Japanese Unexamined patent H1-111087, one technique for identifying positional correspondence between a slice and a measuring point of a sensor is to obtain a peak position which is an approximation obtained by using a least squares method with a weighted fourth or higher order on the profile data and to regard such a peak position as the measuring point corresponding to the slice. However, approximation using the conventional least squares method utilizing a polynomial has resulted in a problem wherein an approximated curve is affected by disturbances such as subpeaks adjacent to the peak position of the response, which prevents proper control when the approximation is applied to control actual paper machine processes.

(3) Optimizing the output of the operation of the slices at the step responses. If disturbance applied to a profile becomes too large at a step response, loss of paper may occur, which results in economic loss to the customer. It is therefore necessary to provide an output which has decreased peak profile or to operate the operated end so that the output amount will not be excessively large. However, too small an amount of output results in a problem wherein the positional correspondence cannot be properly detected because the response of the profile is hidden by the disturbances. Thus, implementation of step responses in controlling profile requires special skills of the operator.

(4) Correcting the positional correspondence of the slices as a whole so that it becomes adequate based on the positional correspondence of the individual slices. Specifically, for slices $N_1, N_2, \ldots, N_r$ from which step responses have been obtained by detecting positions, measuring points $P_2(N_1)$, $P_2(N_2)$, . . . ,$P_2(N_r)$ in positional correspondence to the peak positions are experimentally identified. Also, the paper may contract in the width direction as result of being dried during transportation from the slices to the measuring points. Taking an overall contraction coefficient into consideration, it is possible to calculate measuring points $P_1(1)$, $P_1(2)$, . . . , $P_1(NS)$ which are in positional correspondence. As disclosed in Japanese Unexamined Patent H3-146,784, linear regression analysis may be performed on a plurality of sections in identifying positional correspondence between slices as a whole and measuring points from positional correspondence between particular slices and sensors in order to reduce variations in intervals between positional correspondence.

However, the data of experimentally obtained positional corresonence $P_2(N_1)$, $P_2(N_2)$, . . . , $P_2(N_r)$ between individual slices and the measuring points of the sensors themselves may include variations, and the data are values which are greater or smaller than positional correpondences $P_1(N_1)$, $P_1(N_2)$, . . . , $P_1(N_r)$ which are theoretically determined from an overall contraction coefficient. While the data must be corrected to smooth out such values, the linear regression analysis cannot provide proper representation of continuity at the boundaries between divided regions.

There is another approach wherein an operator observes individual profile responses to identify peak positions based on which an overall positioinal correspondence is set. However, since such setting operation is at the heart of profile control over a paper machine, it can only be under the control of a skilled operator. Thus, when modification must be made, it is difficult for an ordinary operator at the factory to make such modification. This being the case, often a factory will be operated in a non-optimal condition until a skilled engineer is called in.

(5) Determining an interference coefficient which characterizes the degree of effect on a measured value given by operation on an operated end of a paper machine. A technique disclosed in Japanese unexamined patent H4-343,788 has been used for such purpose. According to this technique, a peak of a process interference pattern is expanded in the direction of the width about the vicinity of the peak and within a range of from 0% to 35%. The coefficient for such expansion is determined at the discretion of the operator when first starting the machine. This results in uncertainty of whether an optimum interference coefficient is used for each paper machine.

(6) Logically and quickly determining a membership function $F_{j,m}(x)$ used for operational rules for slice bolts of a paper machine. Japanese Unexamined Patent H4-2,896 discloses a paper machine controller which is capable of reliably flattening a weight profile in the form of a toothed wave using a fuzzy control technique. This involves manual operating techniques performed by a skilled operator. The membership function used in this technique is recursively determined so that the output of each operational rule obtained by the foregoing calculation agrees with the operation of the operator. Thus, there is no definite algorithm for determining the membership function $F_{j,m}(x)$, and such determination is made of each process of a paper machine or coating machine. Such a function is determined by a start up operator at the site of the paper machine on a trial and error basis, which entails time and requires special skills.

SUMMARY OF THE INVENTION

Accordingly, an object of the invention is to overcome the aforementioned and other deficiencies and disadvantages of the prior art.

A first object is to optimize selection of individual and specific slices to be operated in one operation to obtain step responses.

A second object is to identify the measuring point to which each slice corresponds from consideration of a concavoconvex pattern appearing on a sensor when the slice is operated.

A third object is to determine the optimum gain of the operation output of a slice at a step response.

A fourth object is to correct entire slices for proper positional correspondence based on the positional correspondence of particular slices.

A fifth object is to provide a system identifier for a paper machine for calculating an optimum interfence coefficient which characterizes the degree of effect of an operation on an operated end of a paper machine on neighboring measuring points.

A sixth object is to provide a system identifier for a paper machine for autonomously determining a membership function used for profile control which is most suitable for each paper machine.

The foregoing first and other objects are attained by a first aspect of the invention encompassing a system identifier for a paper machine having a plurality (NS) of operated ends provided in the direction of the width of a paper and a detected end having a plurality (NM) of measuring points located in the direction of the width of the paper and downstream of the operated ends for defining to which location of the detected end (J) a particular operated end (I) corresponds, wherein the system identifier comprises means (10) for storing therein positional correspondence $P_1(i)$ between the operated ends and detected end based on contraction of the paper; means (2) for calculating profiles for slices associated with the operated ends by applying measured values at the detected end to the positional correspondence stored in the positional correspondence storing means; means (30) for calculating the conformity of each operated end by multiplying the profile for the slice by an interference coefficient indicating the effect of an operation on the operated end given to the detected end; an output slice selection portion (40) to which data on the conformity of each operated end is applied and for outputting an output slice selection function by performing a neural network calculation wherein self feedback is performed for the operated end and lateral inhibition is performed to inhibit mutual interference between neighboring operated ends within a predetermined range; and a step response output portion (50) for performing step response at operated ends which have survived within the range in which the mutual interference is inhibited.

According to the first aspect of the invention, the theoretical positional correspondence calculation means (10) calculates positional correspondence between the operated ends and the detected end taking the contraction of the paper into consideration. The half slice profile calculation means (20) converts the measured values at the detected end into a data format which is easy to handle in operating the operated ends by reading the measured values as profiles on a half slice basis. The conformity calculation means (30) extracts peaks of profiles by multiplying the half slice profiles by the interference coefficient. The output slice selection portion (40) outputs step responses to the operated ends having conformity to a step response as high as possible using a competition type neural network implementing lateral inhibition and selects the output operated ends at certain intervals to avoid mutual interference between the step responses. The step response output portion (50) outputs step responses. The step response output portion (50) outputs step responses to the operated ends selected by the output slice selection portion (40).

The foregoing second and other objects are attained in a second aspect of the invention which encompasses a system identifier for a paper machine having a plurality (NS) of operated ends provided in the direction of the width of the paper and detected end having a plurality (NM) of measuring points located in the direction of the width of the paper and downstream of the operated ends for defining to which location of the detected end (J) a particular operated end (I) corresponds, wherein the system identifier comprises a step response deviation calculation portion (80) for obtaining a deviation [B(I,J); J=0, 1, . . . , NM−1] between profiles before and after operation of the particular operated end (I); a conversion calculation portion (90) for performing wavelet conversion using a peak position variable "n" and a response expanse variable "m" expressed by $$WB(I, m, n)=J\Sigma m^{-1/2}\times h(J/m)\times B(I, J+n)$$

on the profile deviation obtained by the step response deviation calculation portion where h(x) represents kernels for wavelet conversion localized in a range on the order of the width of the operated end about the peak position variable; and a positional correspondence determination portion (100) for obtaining the pair of peak position variable and response expanse variable which gives the maximum value BMAX of the value WB(I,m,n) calculated by the conversion calculation portion (90).

According to the second aspect of the invention, the step response deviation calculation portion obtains a deviation between the profiles before and after operation on a particular slice; the conversion calculation portion obtains an index for degree of localization of the profile deviation about the measuring points "n" by means of wavelet conversion; and the positional correspondence determination portion obtains the measuring points "n" at which the maximum value is given by the calculation of the wavelet conversion as the measuring point associated with the particular slice.

The foregoing third and other objects are attained by the invention which encompasses a step response deviation calculation portion (8); a conversion calculation portion (90); and a positional correspondence determination portion (100) which are components according to the second aspect of the invention; and further comprising an output gain correction portion (120) for comparing the maximum value obtained by the positional correspondence determination portion (100) with an upper threshold $V_2$ and a lower threshold $V_1$, decreasing a gain G of the operation output of the operated end when the maximum value is equal to or greater than the upper threshold, and increasing the gain of the operation output when the maximum value is equal to or smaller than the lower threshold, thereby correcting the maximum value to be between the upper threshold and the lower threshold.

According to the third aspect of the invention, the output gain correction portion corrects the gain of operation output when the value calculated by wavelet conversion is out of a predetermined range. This optimizes the gain of operation output, prevents the loss of paper caused by disturbances to the profile obtained from step responses and prevents deviation of the profile from being hidden by noise.

The foregoing fourth and other objects are attained by the invention which encompasses a system identifier for a paper machine having a plurality (NS) of operated ends provided in the direction of the width of a paper and a detected end having a plurality (NM) of measuring points located in the direction of the width of the paper and downstream of the operated ends for defining to which location of the detected end (J) a particular operated end (I) corresponds, where the system indentifier comprises means (10) for storing positional correspondence $P_1(i)$ between the operated ends and the detected end based on contraction of the paper; means (130) for identifying positional correspondence $P_2(Nk)$ at step responses from a deviation between measured values at the detected end before and after an operation on the particular operated end (I); means (140) for identifying a deviation of positional correspondence H(Nk) at the step responses from the results of calculations by the theoretical positional correspondence means and the step response means; neural net means (150) to which data on the deviation of positional correspondence is applied and for outputting the deviation signal through an intermediate layer in an amount "m" determined by the number of slices at the operated ends and for converting the input function using predetermined weight function ($w_j1$, $w_j0$, and $v_j(j=0, 1, \ldots, m)$ and a sigmoid function to obtain a positional correspondence deviation function Y(i) which provides a minimized error to the deviation of positional correspondence; and means (160) for correcting $P_3(i)$ the theoretical positional correspondence using the output position correspondence deviation function.

According to the fourth aspect of the invention the theoretical positional correspondence storing means (10) stores theoretical positional correspondence reflecting the contraction of paper; the step response positional correspondence means (130) empirically identifies positional correspondence of a particular slice from a deviation between profiles before and after an operation thereon; the neural net portion (150) to which a deviation of positional correspondence from the theoretical positional correspondence calculation portion and the step response deviation calculation portion is inputted by the deviation means (140) outputs a positional correspondence deviation function which provides a minimized error; and the correction means (160) corrects the theoretical positional correspondence using the positional correspondence deviation function. This allows the system to approximate physical positional correspondence between the slices and the measuring points with high accuracy. Also, the system can be applied to profile control with preferable results and enable production of high quality paper with speed and reliability.

The foregoing fifth and other objects of the invention are attained by the invention which encompasses a step response deviation portion (80), a conversion calculation portion (90), and a positional correspondence determination portion (100) according to the second aspect of the invention, and further comprising means (170) for calculating an interference coefficient for each operated end and each half slice at the particular operated ends.

According to the fifth aspect of the invention, the half slice interference coefficient calculation portion uses a peak position variable that gives the maximum value obtained by the position correspondence determination portion to calculate the interference coefficient for each operated end and each half slice.

The foregoing sixth and other objects are attained in a sixth aspect of the invention,which encompasses the components according to the fifth aspect, and further comprises a process interference coefficient calculation portion (180) for taking an average of the half slice interference coefficients of operated ends which have provided step responses; and means (190) for calculating a membership function for operational rules for the operated ends and neighboring operated ends that define whether they are to be raised or lowered and by what values.

According to the sixth aspect of the invention, the process interference coefficient calculation portion takes an average of the half slice interference coefficients of operated ends which have provided the step responses, thereby calculating a process interference coefficient which is applicable to operated ends in general rather than being aimed at the characteristics of each operated end, and the membership function calculation portion specifically and uniquely calculates a membership function for operational rules which are abstractly defined. This eliminates need for the startup personnel to recursively optimize the membership function, thereby improving flexibility of the system.

BRIEF DESCRIPTION OF THE DRAWINGS

FIG. 1 is a block diagram depicting the relationship between the various aspects of the invention.

FIG. 21 is a chart depicting the case wherein the total number of slices NS is 38 and step responses are those shown in FIG. 18.

FIG. 25 is a diagram depicting still another illustrative embodiment of the invention.

DETAILED DESCRIPTION OF THE PREFERRED EMBODIMENTS

Figure 2:
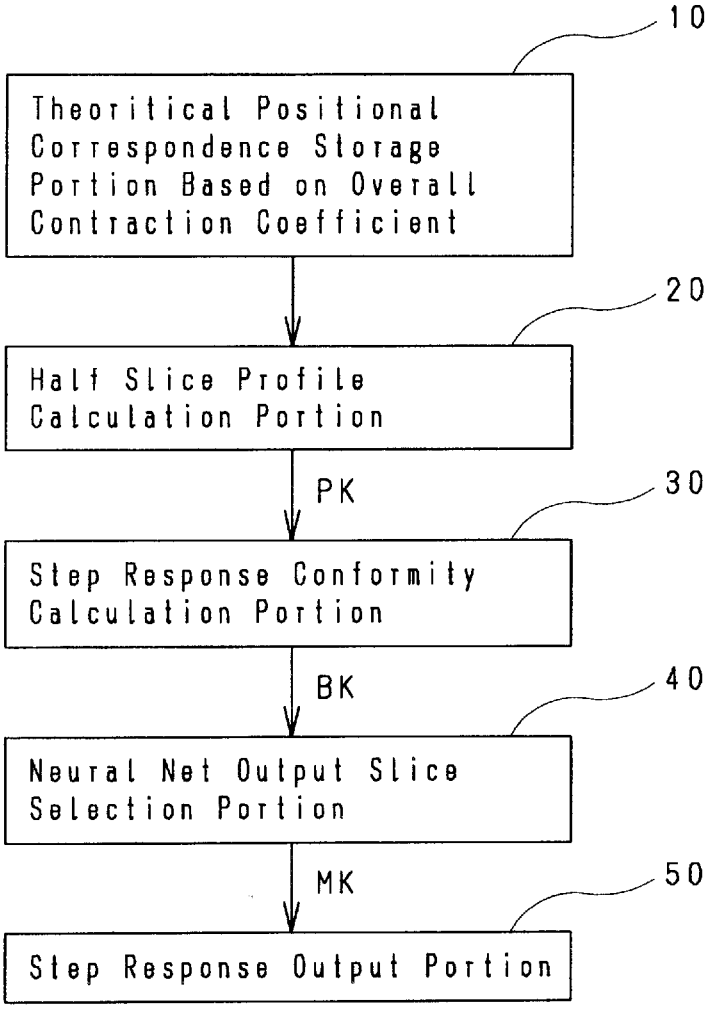
FIG. 2 is a block diagram depicting an illustrative embodiment of the first aspect of the invention.

FIG. 1 shows the relationship between various aspects of the invention, wherein in a paper machine 1, material containing pulp is prepared and outputted by slices 2 disposed in the width direction of the paper, and the weight and moisture content of the produced paper are measured by sensors 3. The data measured by sensors 3 are temporarily stored in measurement data storage portion 4. An operation output portion 5 is provided as an actuator for operating slices 2. As previously stated, the term "slice" or "slices" are used to denote devices which effect slicing of the paper.

According to the first aspect of the invention, measurement data are read from measurement data storage portion 4 and are converted by half slice profile calculation portion 20 into data on a half slice basis using positional correspondence between the measuring points and the operated ends stored in theoretical positional correspondence storage portion 10. Then, step response conformity calculation portion 30 calculates conformity to determine which output slices are to be operated in the current cycle of operation by output slice selection portion 40 and step response output portion 50 issues a command to operation output portion 5. If the step responses are repeated several times, a tested slice registration portion 60 and a step response conformity correction portion 70 are provided to prevent the slices, from which the step response have already been obtained, from being operated in the current operation, to obtain step responses. The term "conformity" is used herein to mean the making of a particular factor substantially equal to another factor.

According to the second and third aspects of the invention, the step response deviation calculation portion 80 reads the measurement data from the storage portion 4 and calculates deviation between the measured values before and after a step response. Then, conversion calculation portion 90 performs a wavelet conversion calculation on the deviation of measured values, and the positional correspondence determination portion 100 determines the positional correspondence. When the output gain from the step response output portion 50 is too large or too small, output gain correction portion 120 corrects the output gain to be a proper output gain.

According to the fourth aspect of the invention, the results of the determination of position correspondence performed by portion 100 is stored in step response positional correspondence portion 130. Then, the deviation between the values in portion 130 and portion 10 is stored in positional deviation storage portion 140. Such deviation positional correspondence is sent to neural net portion 150 to calculate an optimum correction amount, and the positional correspondence correction portion 160 determines the positional correspondence which is considered to be most suitable for profile control.

According to the fifth and sixth aspects of the invention, there is provided a step response deviation calculation portion 80, a wavelet conversion calculation portion 90, and a positional correspondence determination portion 100 which are components used in the second and third aspects of the invention. A half slice interference factor calculation portion 170, as a component unique to the fifth aspect of the invention, calculates an interference coefficient for each operated end and each half slice using a peak position variable obtained by portion 100. As a result, an interference coefficient is obtained for an operated end of a paper machine to indicate the degree of effect on the measured value produced by operation on the operated end. In the sixth aspect of the invention, the process interference factor calculation portion 180 averages the interference coefficients, obtained for individual operated ends, to calculate an interference coefficient for an operated end having average properties. The membership function calculation portion 190 specifically and uniquely calculates a membership function for the operational rules which are abstractly defined using the process interference coefficient.

Each aspect of the invention will now be described with reference to the remaining figures of the drawing. FIG. 2 shows the theoretical positional correspondence storage portion 10 which stores theoretical positional correspondence $P_1(i)$ between the operated ends and the detected end which is identified by taking into consideration the contraction of the paper, which occurs during movement of the paper from the slices of the paper machine to the measuring points of the sensors. If the paper machine is already in operation, positional correspondence between the operated ends currently in use and the detected end may be stored. The total number of slices, which are the operated ends, is represented by NS, and the total number of profile measuring points is represented by NM.

Half slice profile calculation portion 20 applies the measured values at the detected end to the theoretical positional correspondence $P_1(i)$ stored in storage portion 10 to calculate profiles of each operated end and each virtual half slice located between the operated ends, thereby converting the measured values into a data format which is easier to use in operating the operated ends. Assume that the measure value at each detected end is represented by PR(i), wherein i=0,1,2, . . . , NM−1, and assume that the theoretical positional correspondence of each half slice is represented by $P_1H(i)$ where i=1,2, . . . , 2·NS−1. Then, the following equations are satisfied:

$$P_1H(2\cdot-1)=P_1(i) \quad (1)$$

wherein i=1, 2, . . . , NS.

$$P_1H(2\cdot i)=[P_1(i)+P_1(i+1)] \quad (2)$$

wherein i=1, 2, . . . , NS−1.

In order to reduce the effects of noise on the measured values, the average of the measured values at the detected end, included in the width of the half slices, is obtained. Assume that this value is a half slice mean total HMT. Then, the half slice profile HP(i) is defined as follows:

$$HP(i)=[HMT2j=-HMT2\Sigma PR(P_1H(i)+j)]/HMT \quad (3)$$

wherein i=1, 2, . . . , 2·NS−1.

The coefficient HMT2 satisfies the following equation:

$$\mathrm{HMT2}=(\mathrm{HMT}-1)/2 \quad (4)$$

The half slice meant total HMT is an odd number.

Conformity calculation portion 30 multiplies the half slice profile by an interference coefficient indicating the effect on the detected end of an operation on the operated end to calculate the conformity of each operated end. Assume that the conformity of a downward step response is represented by $Ak,_0$; the conformity of and upward response is represented by $Ak,_1$; the conformity of a step response is represented by Bk where k=1,2, . . . , NS; and the half slice interference coefficient is represented by Wi,where i=−4 to +4. Then, the following equations are satisfied:

$$\begin{aligned} Ak_0 &= 4\cdot \mathrm{MAX}[+4_{i=-4}\Sigma\log[Wi\cdot HP(2k-1+i)+1],0] \\ Ak_1 &= 4\cdot \mathrm{MAX}[+4_{i=-4}\Sigma\log[-Wi\cdot HP(2k-1+i)+1],0] \\ Bk &= \mathrm{MAX}(Ak,_o, Ak,_1) \end{aligned} \quad (5)$$

wherein k=1, 2, . . . , NS.

If the process identification of the interference coefficient has not yet been performed, a typical value is temporarily set.

The conformity of each operated end is applied to the output slice selection portion 40 which in turn outputs an output slice selection function by performing a neural network calculation wherein self feedback is performed for inhibiting mutual interference between neighboring operated ends within a predetermined range. The lateral inhibition has a first property of detecting the maximum value or an equivalent thereto in an area of an input pattern and a second property wherein neurons that survive the competition exist at predetermined constant intervals. The first property satisfies the need for providing step responses by extracting operated ends having conformity to the step responses as high as possible, that is, by extracting the area about the peak of the profile. The second property satisfies the limitation that output operated ends must be selected at certain intervals to prevent mutual interference between the profile responses. These will be discussed in detail with reference to FIG.2.

The step response output portion 50 uses the output slice selection function to provide a step response at an operated end which has survived within the range wherein mutual interference is inhibited, as described above. An output value Vk of a k-th operated end which has survived is obtained by multiplying the value of the output slice selection function Mk by the output gain G. For example, if the conformity $Bk=Ak,_0$ for the k-th operated end for which Mk=1, then Vk=−G (that is downward). On the other hand, if conformity $Bk=Ak,_1$, then Vk=G (that is upward).

Figure 3:
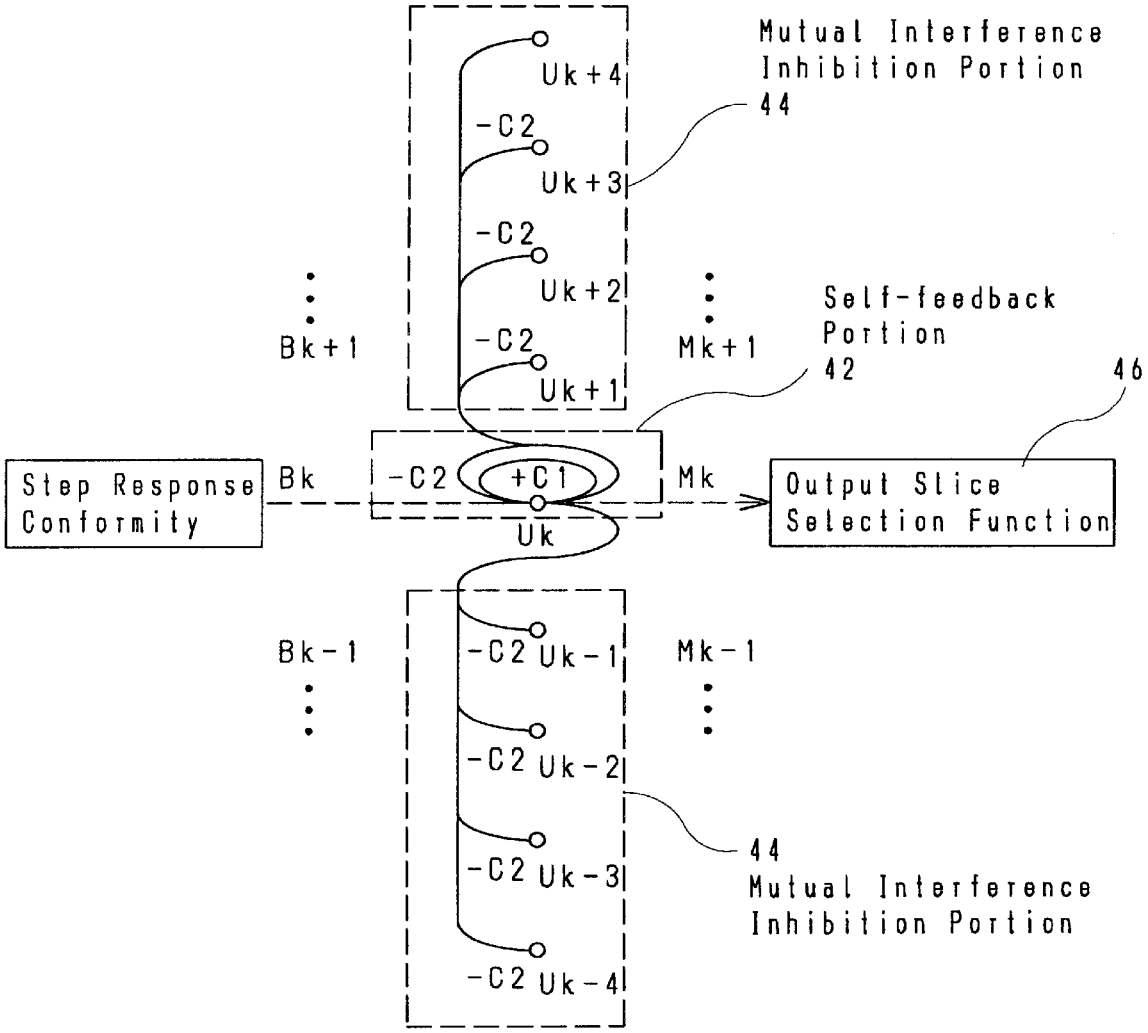
FIG. 3 is a diagram depicting major parts of a neural network with lateral inhibition forming a part of an output slice selection portion.

FIG. 3 illustrates a configuration of major parts of a neural network which implements lateral inhibition and which forms a part of the output slice selection portion 40. The neural network which is shown is with lateral inhibition for the k-th end. The conformity Bk to a step response is inputted to a unit Uk which corresponds to the k-th operated end. The initial value of the unit Uk agrees with the confomity Bk and is a non-negative integral (Uk≧0). The value of the output slice selection function Mk is a value which is outputted when the calculation of the unit Uk is completed. When Mk=1, an operated end which has survived is indicated. On the other hand, when Mk=0, an operated end which has not be selected is indicated.

The self feedback portion 42 provides feedback to the unit Uk associated with portion 42 with a coefficient $C_1$. The mutual interference inhibition portion 44 provides negative feedback of the values of unit Uk to neighboring contacts Uk−L, . . . , Uk−1, and Uk+L, . . . , Uk+1 within the range of a step response interval L with a coefficient $C_2$.

Portion 42 also provides negative feedback to unit Uk associated with portion 42 with coefficient $C_2$. The step response interval L has a value such that no mutual interference occurs and must be set so that the number of step responses is minimized. For example, the interval is set at 4 or 5. The coefficient $C_1$ for self feedback and the coefficient $C_2$ for negative feedback are determined as follows:

$$C_1=(2K+1)/2K \quad (6)$$

$$C_2=½K \quad (7)$$

The (t+1)-th calculation for unit Uk(t), wherein t≧0, satisfies the following equation:

$$Uk(t+1)=f[C_1Uk(t)-C_2[^{+L}j=-L\ \Sigma Uk+j(t)]+Bk] \quad (8)$$

wherein Σis obtained for j which satisfies 0≦k+j≦NS. The first intermediate function f(x) is determined as follows:

$$\begin{aligned} f(x) &= x(x \geqq 0) \\ &= 0(x<0) \end{aligned} \quad (9)$$

Furthermore, the second intermediate function g(x); (x≧0) is defined as follows:

$$\begin{aligned} g(x) &= 1(x>0) \\ &= 0(x=0) \end{aligned} \quad (10)$$

The value of the output slice selection function Mk(t) at the t-th calculation is defined as follows:

$$Mk(t)=g[Uk(t)] \quad (11)$$

wherein K=1, 2, . . . , NS.

Then a step response is provided for the operated end for which Mk(t)=1 when t is large enough.

Figure 4:
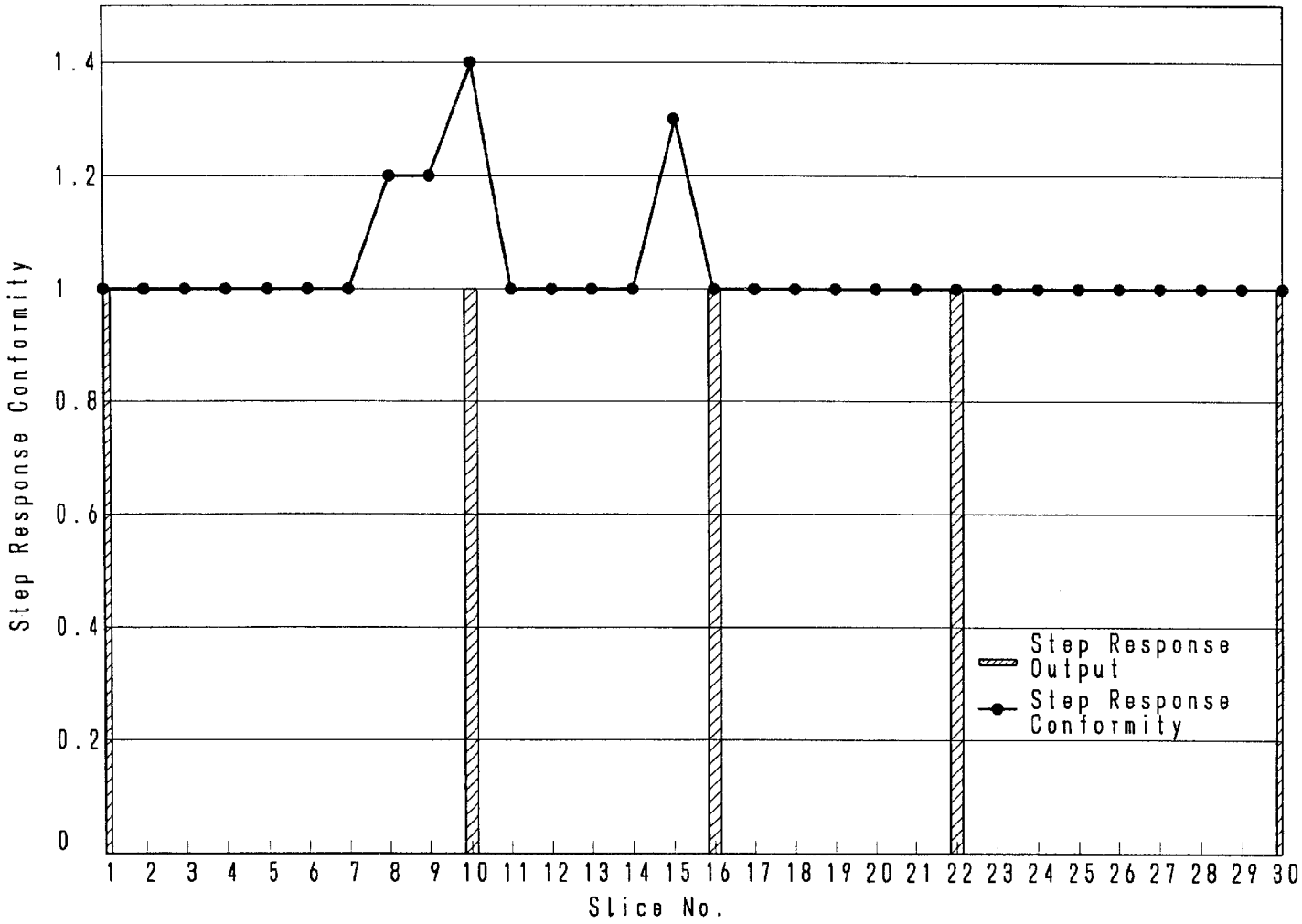
FIG. 4 is a diagram depicting a first example of the results of calculation by the output slice selection portion.

The operation of the apparatus having the above described configuration will now be described with reference to FIG. 4 which shows a first example of the results of calculation at portion 40. In this case the number NS of slices which are operated ends is 30, the step response interval L is 5, and the number of calculations at the neural network is 100. The conformity Bk is 1.4 for the 10th slice, 1.2 for the 8th slice, and the 9th slice, 1.2 for the 15th slice, and 1.0 for the remaining slices. Then,the slices for which Mk(t)=1 are the 1st, 10th, 16th, 22nd, and 30th slices. Since the output slice selection function is 1 for the 10th slice, the 15th slice having high conformity should be the next slice selected. However, sine 5 is selected as the step response interval L, the 16th slice is selected which is at the minimum interval of 5.

Figure 5:
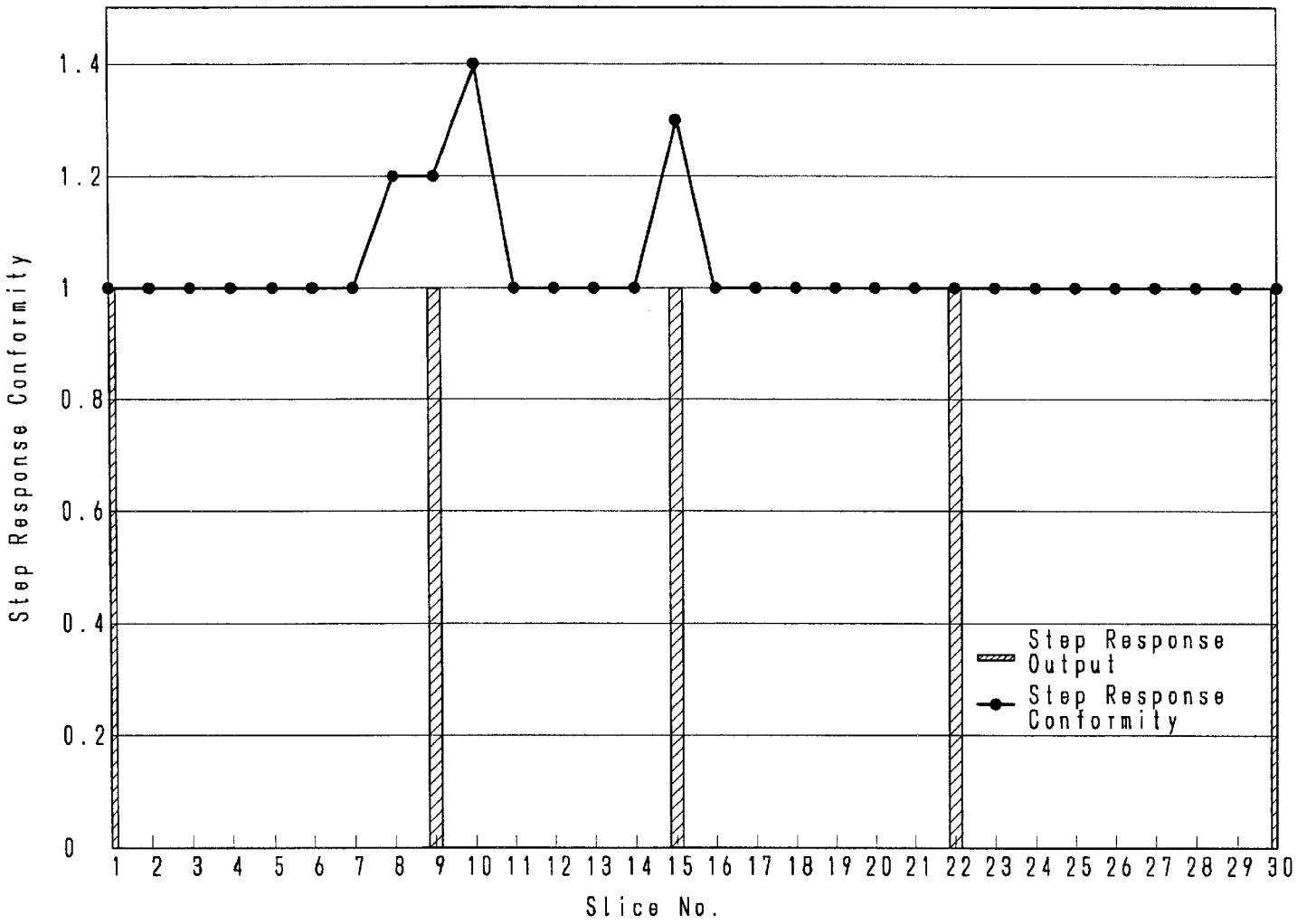
FIG. 5 is a diagram depicting a second example of the results of calculation by the output slice selection portion.

FIG. 5 shows a second example of the results of calculation at portion 40. Since conformity $B_{15}$ of the 15th slice is 1.3, the 15th and 9th slices survive because the output slice function is 1 for each.

Figure 6:
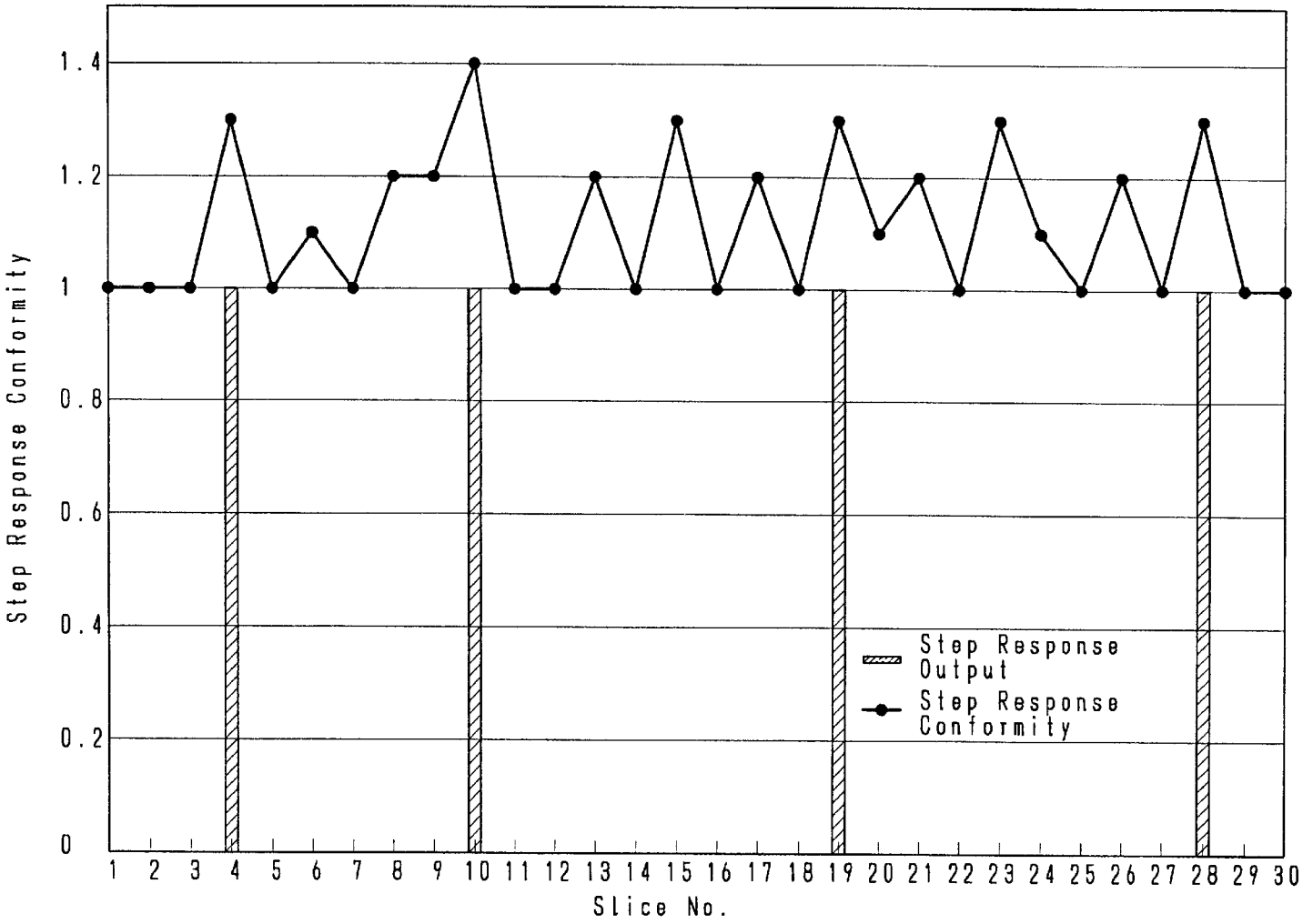
FIG. 6 is a diagram depicting a third example of the results of calculation by the output slice selection portion.

FIG. 6 shows a third example of the results of calculation by portion 40. The conformity Bk for the slices varies significantly with the range of 1.0 to 1.4. The 4th, 10th, 19th and 28th slices are selected as slices for which the output slice selection function is 1. An overview of the characteristics of the selected slices indicates that the operated ends having conformity are selected, on balance, at intervals of 5 or more.

Figure 7:
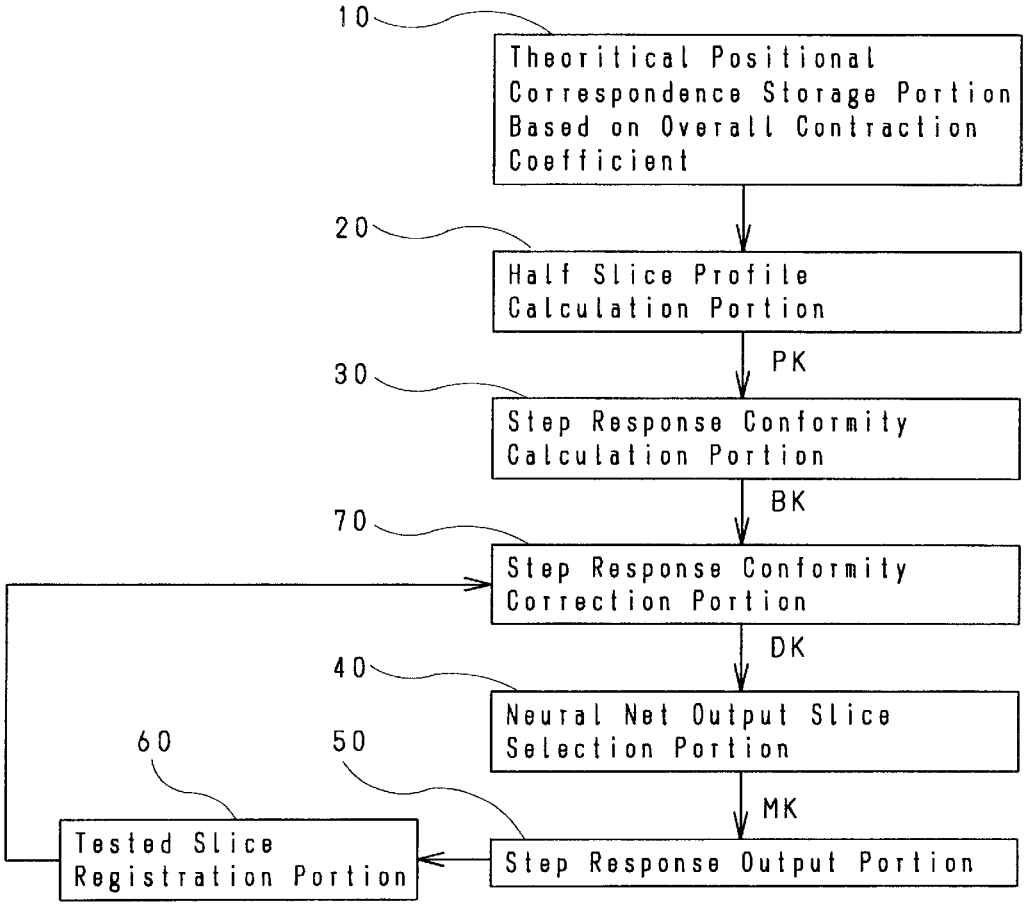
FIG. 7 is a block diagram depicting another illustrative embodiment of the first aspect of the invention.

FIG. 7 shows another illustrative embodiment. As previously described, step responses are obtained for one half or one third of the total number of slices. Also, the number of slices which can be operated at one time is limited to about one sixth of the total number in order to maintain intervals of, for example, 5 slices so as to prevent mutual interference between the measured values of step responses. It is therefore necessary to make preparations for several repeated step responses. Accordingly, in the embodiment of FIG. 7, a tested slice registration portion 60 ad a step response conformity correction portion 70 are added to the embodiment of FIG. 1.

The tested slice registration portion 60 registers the operated end from which step functions have already been obtained by portion 50. The step response conformity correction portion 70 makes a correction on the operated ends registered in portion 60 so that their conformity Bk, calculated at portion 30, becomes smaller in value in an attempt to prevent the conformity Bk from surviving the portion 40. Thus, the operated ends, from which step responses have not yet been received, are selected.

Assume that a step flag (k,j) represents the number of step responses provided by the k-th slice in a direction j. (wherein j=0 represents a downward direction, and j=1 represents an upward direction ) Then, the conformity of downward step response $Ak,_0$ and the conformity of upward step response $Ak,_1$ in equation (5) are corrected using the following equation (12). The values before and after the correction are denoted with the superscripts "old" and "new", respectively.

$$Ak,_j\text{new} = Ak,_j\text{old} - \alpha - 1 \cdot \text{Stepflag}(k-1, j) - \alpha_0 \cdot \text{Stepflag}(k, j) - \alpha_{+1} \cdot \text{Stepflag}(k-1, j) \quad (12)$$

wherein k=1, 2, . . . , NS, and j=0 or 1.

The conformity of the operated ends on both sides of the operated ends which have already provided step responses is also corrected using tested operated end adjustment coefficients $\propto_{-1}$ and $\propto_{+1}$ because there is a close resemblance in step responses between the actual operated ends and the operated ends on both sides, and it is necessary to prevent step responses from the latter from being selected.

The step response conformity correction value $Dk_j$ is defined as follows:

$$Dk=MAX(Ak,0^{new}, Ak, 1^{new}) \quad (13)$$

The calculation at the neural net output slice selection portion 40 is performed with the initial value of Uk set at Uk(0)=Dk, and Bk in equation (8) is replaced with Dk.

Although the calculation of conformity using a half slice profile and an interference coefficient has been shown in the above embodiment, the first aspect of the invention is not limited thereto, For example, the profile may be calculated for the operated ends. For a paper machine having 100 operated ends or more, the required accuracy can be obtained on a slice basis without complicated profile calculations, such as on a half slice basis.

As discussed, the peak of a profile is obtained after multiplying the profile by an interference coefficient at the portion 30. This prevents deviation of the profile in the step response from becoming larger than the specification, thereby preventing the occurrence of paper loss. Furthermore, the neural output slice selection portion 40 performs a lateral inhibition type neural network calculation, and the operated ends which have survived the calculation are selected as the operated ends to be operated at the current step response. This results in prevention of mutual interference at the step response. Also, in the embodiment of FIG. 7, the step response conformity correction portion 70 is provided to make a correction which reduces the conformity of the operated ends from which the step responses have already been obtained, so that they will not survive the portion 40 as the operated end to be operated at the next step response. In this manner, the step responses can be obtained from the required operated ends with a minimum number of operations for obtaining the step responses.

The positional correspondence stored in portion 10 will now be described. In simple terms, the positional correspondence is that having an initial value obtained on the assumption that a coefficient $\propto$ of overall contraction of paper is constant in the direction of the width of the paper. Contraction of paper may occur during transport of the paper from the inlet to the reel, for example. The overall contraction coefficient $\propto$ satisfied the following equation:

$$\propto=(W_1-W_2)/W_1 \quad (14)$$

wherein $W_1$ represents the width of the paper at the inlet and $W_2$ represents the width of the paper at the reel. However,an initial value of positional correspondence between the points where the quality of the paper is measured and the slices obtained using the overall contraction coefficient $\propto$ results in a significant deviation from actual positional correspondence especially in the case of a large paper machine having 100 or more slices. This results in the possibility that the convergence of a convergent calculation using the neural network calculation or the like may be adversely affected.

Close observation of the contraction of the paper may reveal that the paper was not dried uniformly in the direction of the width of the paper. Also, measurement of the contraction coefficient of different parts of the paper necessitates operations, such as described below, which involve increased labor, loss of paper, a danger. For example, a roll, located at the entrance or inlet of the press, is marked with a marker pen at constant intervals of about 20 cm. The ink applied to the roll is transferred to the paper. When the paper is taken up by the reel, the constant intervals between the ink marks are measured by taking up the paper and examining the paper to determine how it has contracted. This requires increased labor at the time of start up for each different batch of paper.

Figure 8:
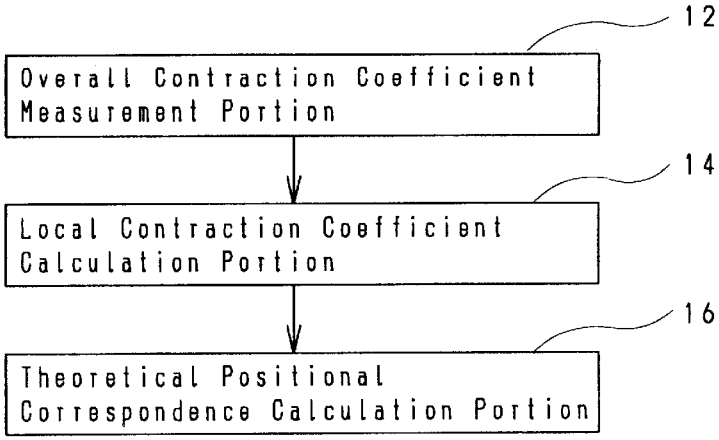
FIG. 8 is a block diagram depicting another illustrative embodiment of the theoretical positional correspondence storage portion.

Accordingly, there is need for a calculation which provides an initial value of positional correspondence which results in less deviation from the actual positional deviation with use of a simple operation. FIG. 8 shows another illustrative theoretical positional correspondence storage portion 10, wherein an overal contraction coefficient measurement portion 12 measures actual contraction of the paper width $W_1-W_2$ between the operated ends and a detected end, and calculates the overall coefficient $\propto$ using equation (14). A local contraction coefficient calculation portion 14 determines the contraction coefficient at the ends and the center of the paper using the overall contraction coefficient and further determines the distribution of contraction coefficients between the ends and the center so that the coefficients are consistent with the overall contraction coefficient. The theoretical positional correspondence calculation portion 16 calculates theoretical positional correspondence between the operated ends and the detected end.

Figure 9:
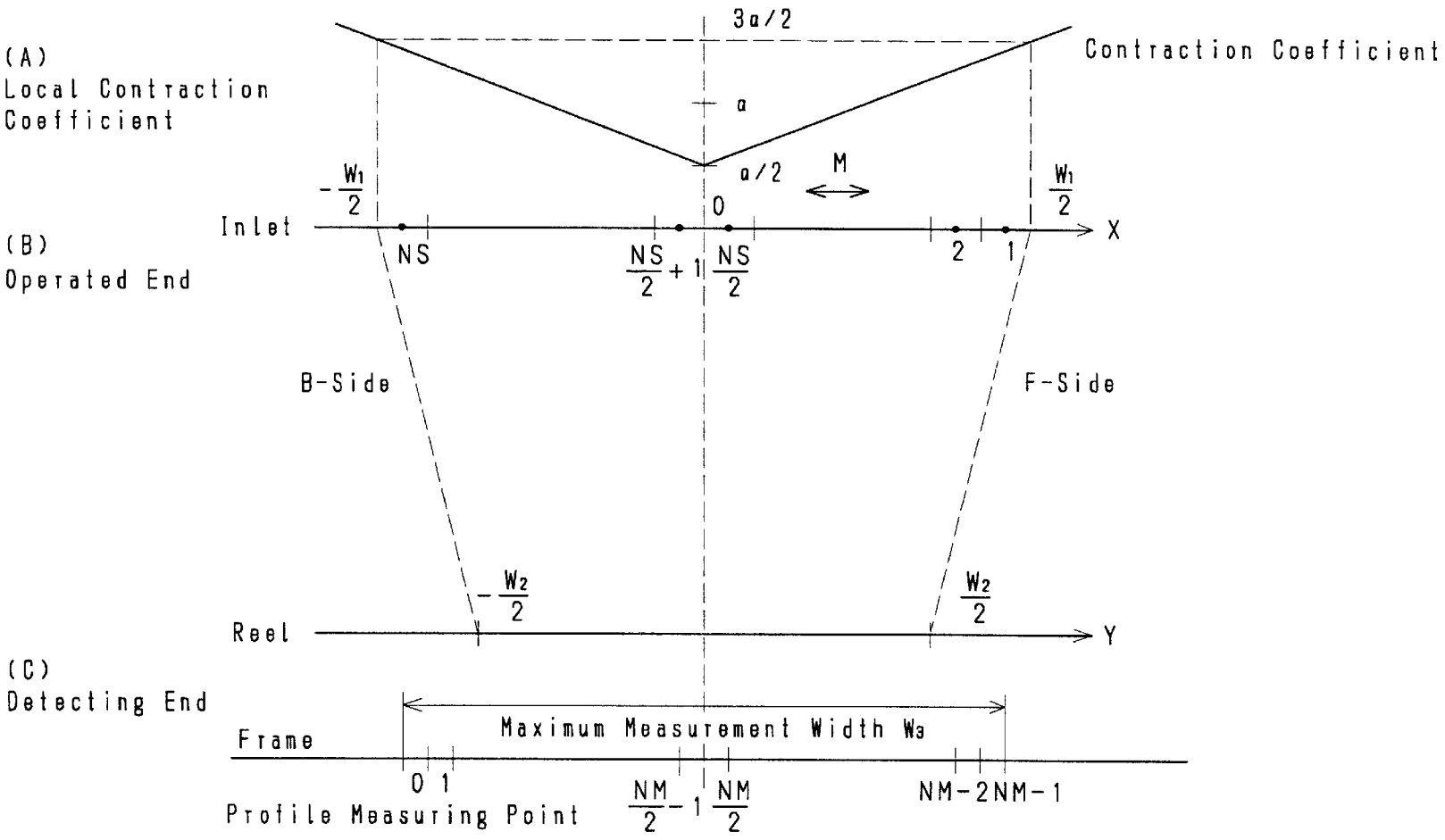
FIG. 9 is a diagram depicting theoretical positional correspondence between an operated end and a detected end.

FIG. 9 shows theoretical correspondence between the operated ends and a detected end wherein "A" designates a distribution curve for local contraction coefficients; "B" designates the operated ends; and "C" designates the detected end. The results of measurements indicate that local contraction coefficient $\propto(x)$ are small around the center of the width of paper nad are greater in peripheral areas. For example, the contraction coefficient near the center is represented by $\propto/2$; the contraction coefficient in peripheral areas is represented by $3\propto/2$; and the contraction coefficients between those areas are linearly approximated. The local contraction coefficient $\propto(x)$ is given by the following equations where x designates the coordinate of the exit of the inlet; the unit is mm, and x=0 represents the machine center.

$$\alpha(x) = \frac{-2\alpha}{W_1}x + \frac{\alpha}{2}\left(-\frac{W_1}{2} \leqq x \leqq 0\right) \tag{15}$$

$$\alpha(x) = \frac{2\alpha}{W_1}x + \frac{\alpha}{2}\left(0 \leqq x \leqq \frac{W_1}{2}\right) \tag{16}$$

The following integration calculation shows that the overall contraction coefficient is represented by $\propto$.

$$\int_{-w_1/2}^{0}(1-\alpha(x))dx + \int_{0}^{W_1/2}(1-\alpha(x))dx - \int_{-W_1/2}^{0}\left[1-\left(\frac{-2\alpha}{W_1}x+\frac{\alpha}{2}\right)\right]dx + \int_{0}^{W_1/2}\left[1-\left(\frac{2\alpha}{W_1}x\frac{\alpha}{2}\right)\right]dx = (1-\alpha)W_1 - W_2 \tag{17}$$

Next, the theoretical positional correspondence calculation portion 30 calculates the theoretical positional correspondence using local contraction coefficient $\propto(x)$ Assume that the number of operated ends is represented by NS; the width of one operated end is represented by MA (mm); and the maximum measurement width of the sensor is represented by $W_3$(mm). Then, the position MM (i) in terms of x-coordinate from a machine center in the center of the i-th operated end is expressed by the following equation:

$$MM(i) = \left[-i + \frac{NS+1}{2}\right]\cdot M(\text{mm}) \tag{18}$$

Next, theoretical positional correspondence P1(i) where i=0, 1, . . . , NM−1 based on the contraction coefficient is expressed as follows:

$$P1(i) = \frac{NM-1}{2} + \frac{NM}{W_3}\int_{0}^{MM(i)}(1-\alpha(x))dx \tag{19}$$

If i≦(NS+1)/2, then MM(i)≧0. In this case, equation (4) is calculated as follows:

$$\begin{aligned} P1(i) &= \frac{NM-1}{2} + \frac{NM}{W_3}\int_{0}^{MM(i)}(1-\alpha(x))dx \\ &= \frac{NM-1}{2} + \frac{NM}{W_3}\int_{0}^{MM(i)}\left[1-\left(\frac{2\alpha}{W_1}x+\frac{\alpha}{2}\right)\right]dx \\ &= \frac{NM-1}{2} + \frac{NM}{W_3}\left[-\frac{\alpha}{W_1}x^2+\left(1-\frac{\alpha}{2}\right)x\right]_0^{MM(i)} \\ &= \frac{NM-1}{2} + \frac{NM}{W_3}\left[-\frac{\alpha}{W_1}MM(i)^2+\left(1-\frac{\alpha}{2}\right)MM(i)\right] \end{aligned} \tag{20}$$

If i>(NS+1)/2, then MM(i)<0. In this case, equation (4) is calculated as follows:

$$\begin{aligned} P1(i) &= \frac{NM-1}{2} + \frac{NM}{W_3}\int_{0}^{MM(i)}(1-\alpha(x))dx \\ &= \frac{NM-1}{2} + \frac{NM}{W_3}\int_{0}^{MM(i)}\left[1-\left(-\frac{2\alpha}{W_1}x+\frac{\alpha}{2}\right)\right]dx \\ &= \frac{NM-1}{2} + \frac{NM}{W_3}\left[\frac{\alpha}{W_1}x^2+\left(1-\frac{\alpha}{2}\right)x\right]_0^{MM(i)} \\ &= \frac{NM-1}{2} + \frac{NM}{W_3}\left[\frac{\alpha}{W_1}MM(i)^2+\left(1-\frac{\alpha}{2}\right)MM(i)\right] \end{aligned} \tag{21}$$

The embodiment of FIG. 9 is the case wherein the contraction coefficient around the center is represented by $\propto/2$; the contraction coefficient in the peripheral areas is represented by $3\propto/2$; and the contraction coefficient between the foregoing areas are linearly approximated. However, the embodiment is not limited to such case. The contraction coefficients about the center and at the ends of the paper may be other values as long as the contraction coefficient is gradually decreased from the ends of the paper to the center thereof. Moreover, the approximated curve of contraction coefficients is not limited to linear approximations and may be a quadratic curve or the like.

In the embodiment of FIG. 8, the theoretical positional correspondence between the operated ends and the detected end is obtained by approximating the contraction of paper based on the assumption that the contraction coefficient is greater at the ends of the paper than at the center thereof. Consequently, there is provided an initial value which is preferable to one which is based on uniform contraction of the paper with an overall conversion coefficient $\propto$.

The second aspect of the invention will now be described with reference to FIG. 10, wherein the step response deviation calculation portion 80 operates a particular slice I and obtains a deviation between the profiles before and after the operation:

$$B(I,J)=B1(I,J)-B0(I,J) \tag{22}$$

wherein I represents the number of the slice (I=1, . . . , N, where N is the total number of slices , which is typically several dozens although such number depends on the paper machine being used); J represents the profile measuring point; B1(I,J) represents the profile after operation on slice no. I; and B0(I,J) represents the profile before operation on slice no.I. The total number of profile measuring points is represented by NM, and each measuring point is indicated by a number, such as J=0, 1, . . . ,NM−1. For example, NM is 360 points and the width of the measuring points per slice is 10, if the total number of slices N is 36. The profile B1(I,J) and B0(I,J) before and after operation on the slice may be the average of several measured values with noise eliminated or may be obtained from profiles measured during or close to the time of operation.

The conversion calculation portion 90 performs wavelet conversion on the profile deviation obtained at the step response deviation calculation portion 80 to provide an index indicating the degree of localization of the profile deviation about the measuring point "n". Wavelet conversion on a continuous variable "x" will be first described. First, consider the following function h(x):

$$h(x)=2\times 3^{-1/2}\times\pi^{-1/4}\times(1-x^2)\times\exp(-x^2/2) \tag{23}$$

which provides the following equation if "x" is a real number and (R) and "m" and "n" are natural numbers:

$$h_{m,n}(x)=m^{-1/2}\times h[(x-n)/m] \tag{24}$$

Wavelet conversion using function h(x) is an integration conversion, as shown below with $h_{m,n}(x)$ serving as the kernel:

$$\begin{aligned}(Wf)(m,n) &= \int_{-\infty}^{+\infty}\frac{1}{\sqrt{m}}\,h\left(\frac{x-n}{m}\right)f(x)dx \\ &= \int_{-\infty}^{+\infty}\frac{1}{\sqrt{m}}\,h\left(\frac{y}{m}\right)f(y+n)dy\end{aligned} \tag{25}$$

wherein $f\in L^2(1R)$ (i.e. square integrable).

Figure 11:
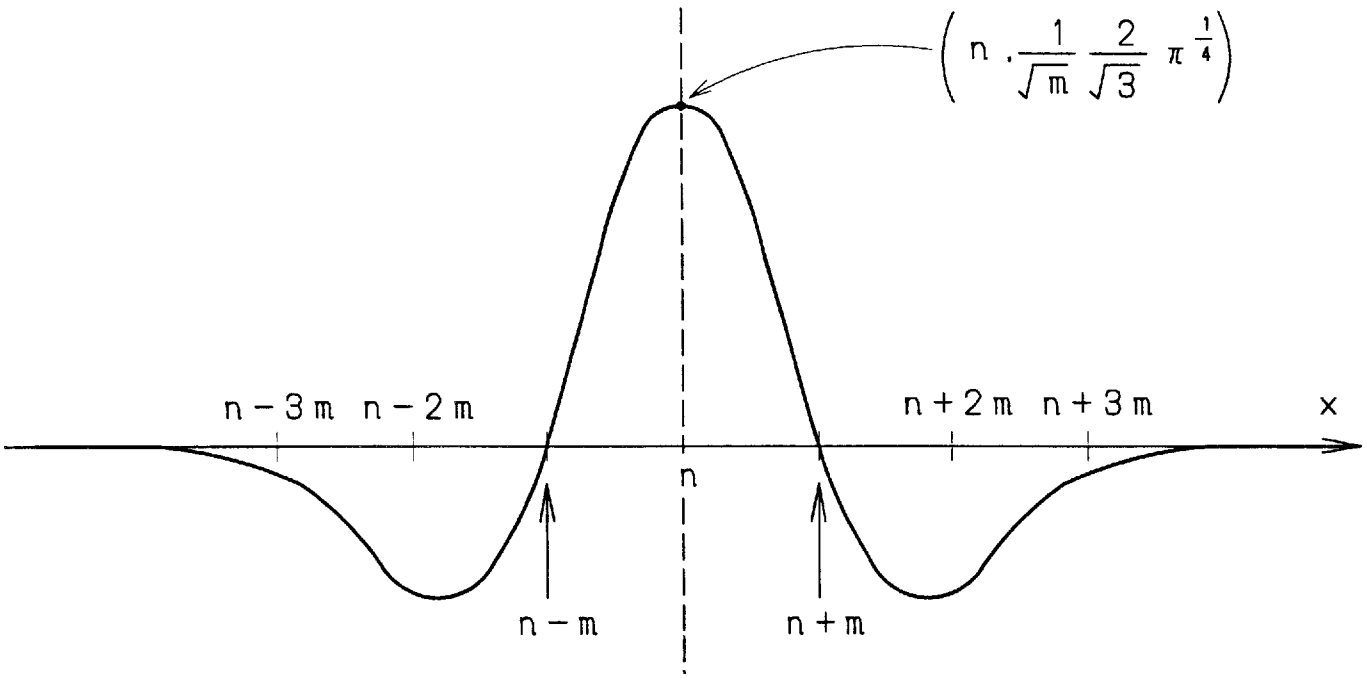
FIG. 11 is a diagram depicting function $h_{m,n}(x)$.

The wavelet function is derived from studies on the propagation of earthquake waves and represents the state wherein energy of a pulse like wavefrom laterally diffuses as it is propagated on the earth's crust. Thus, unlike Fourier transformation which deals with sine waves, and the like, wherein a waveform does not converge on zero even at plus or minus infinity,the wavelet function provides a large amplitude of a waveform only in the vicinity of a peak thereof, and the amplitude is substantially zero at plus and minus infinity. It is possible to obtain information on the localization of f(x) around x=n by correlating $h_{m,n}(x)$ and f(x). FIG. 11 shows a functional diagram of the function $h_{m,n}(x)$ which is a concavoconvex curve reaching a maximum value of $$m^{-1/2}\times 2\times 3^{-1/2}\times\pi^{-1/4}$$

when x=n and reaching zero when x=n±m and which has one peak in the positive direction and two peaks in the negative direction. The curve asymptotically approaches zero when x=n±∝.

Since the actual measuring points "J" are discrete, calculation thereof can be made using the following equation which is a modification of equation (25) into a summation.

$$WB(I,m,n)=+3m_{j=-3m}\Sigma_m^{-1/2}\times h(J/m)\times B(I,J+n) \tag{26}$$

The summation is performed on measuring points J. Since the wavelet function provides a large amplitude of a waveform only in the vicinity of the peak thereof, as described above, a sufficiently accurate value can be calculated from the sum obtained within the range of ±3m about the measuring point J=n. In other words, this is to limit the summation of WB(I,m,n) to the range of J=−3m to +3m. Integration of equation 25 may be approximated in the range of n=±3m, since hm,n(x) equal substantially zero within the range when x>n+3m and x<n−3m.

The positional correspondence determination portion 100 calculates the value WB(I,m,n) of the wavelet conversion for the step response B(I, J+n),when J=−3m to +3m, for the slice I with the values of "m" and "n" being varied. When values "m" and "n" are determined which gives maximum value BMAX, it can be considered that such value "n" produces a peak position of the step response. It can also be considered that value "m" at that time produces the expanse of the step response.

Value "n" is in the range of n=P1(I)−M~P1(I)+M wherein P1(i) represents the position of slice I determined by the overall contraction coefficient. "M" represents the width of the measuring points per slice. This is because experience indicates that there is almost no possibility of deviation in the excess of the width corresponding to one slice from the position determined by the contraction coefficient. The value "m" is in the range of m=M to 2M because m<M is a physical impossibility due to the nature of the paper making process, and because m>2M is almost impossible based on practical experience.

The above calculation provides maximum value BMAX of WB(I,m,n). When the maximum value BMAX is equal to or smaller than the threshold value $V_0$, the detection of a peak is unsuccessful due to noise and disturbances to the process. Thus, such data of the peak position is eliminated. Accordingly, use of the wavelet conversion makes it possible to judge the significance of the data of each step response. The wavelet conversion can be applied to the display of trend data using the pixels at predetermined positions.

Figure 12:
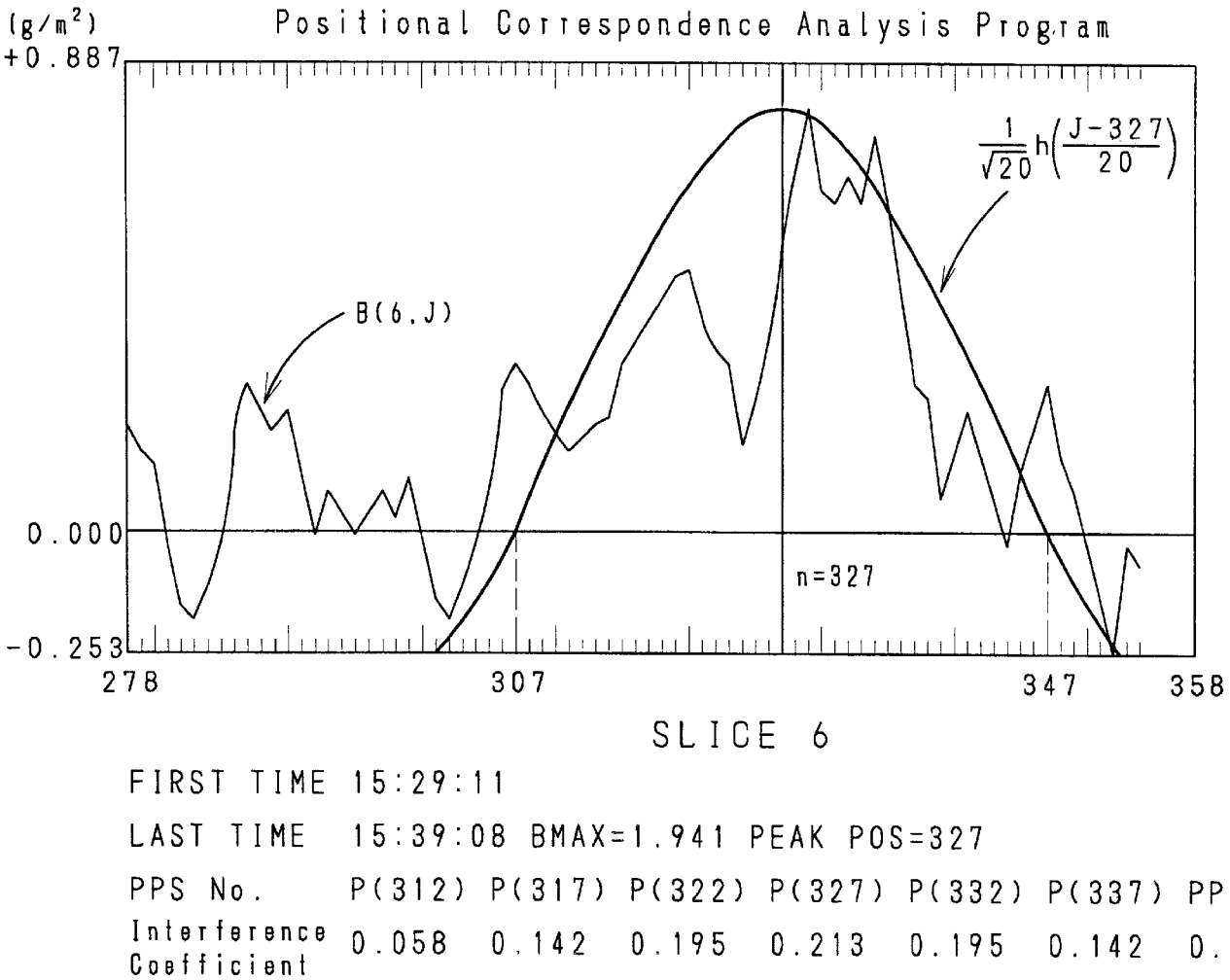
FIG. 12 is a diagram depicting position correspondence analysis.

The operation of the embodiment will now be described with reference to FIG. 12 which shows positional correspondence analysis wherein a slice is operated in the direction of increasing weight of paper. In FIG. 12, the zigzag shaped curve B(6,J) indicates deviations of weight profile and represents step responses to the sixth slice which is an operated end. The values at the upper and lower ends of the vertical axis are 0.887 [g/m$^2$] and −0.235 [g/cm$^2$], respectively. The horizontal axis represents the positions of the measuring points, and the 278th and 358th measuring points are shown at the left and right ends, respectively. The convex curve indicates the kernel $h_{m,n}(x)$ of integrating conversion when n=327 and m=20. The scale on the vertical axis has been adjusted to be more suitable for curve B(6,J).

The alphanumeric display at the lower part of FIG. 12 represent the following. "FIRST TIME" designates the profile B0(6,J) before operation on the sixth slice, and the time of measurement "15:29:11" is shown thereafter. "LAST TIME" designates the profile B1(6,J) after operation on the sixth slice, and the time of measurement"15:39:08) is shown thereafter. "BMAX" designates the maximum value of WB(I,m,n) which is calculated by wavelet conversion and is shown next as 1.941. "PEAK POS" designates the number of the measuring point of the peak position which is shown next as 327 (=n). "PPS NO" designates the measuring point numbers, and the measuring point numbers in every fifth place are shown thereafter in correspondence with the measuring points shown on the horizontal axis. For example, P(312) is the measuring point P for number 312. In this case, since the width "M" of one slice substantially corresponds to 10 measuring points, 5 measuring points correspond to a half of the width of one slice (also called a half slice width). "INTERFERENCE COEFFICIENT" designate the normalized values of the deviation curve B(6,J) which indicate degree of distribution of operation on the slice to each half slice width on a dimensionless basis. In this case, the values of five points neighboring the measuring point indicated by "PPS NO." on the left and right sides thereof are averaged at points which are symmetric about the point corresponding to the peak position n=327.

Figure 13:
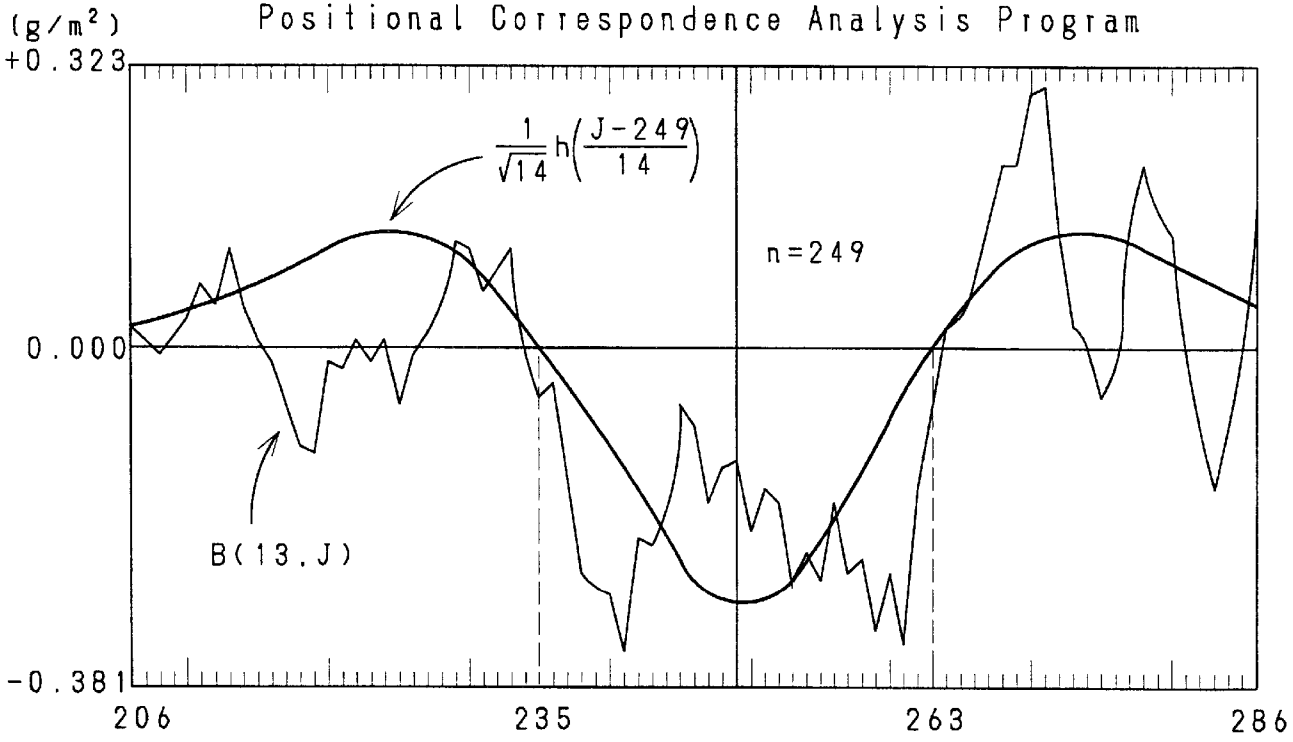
FIG. 13 is a diagram depicting another position correspondence analysis.

FIG. 13 shows positional correspondence analysis wherein a slice is operated in the direction of decreasing weight of paper. In FIG. 13, the zigzag shaped curve B(13,J) indicates deviations of the weight profile and represents step responses to the 13th slice which is an operated end. The values at the upper and lower ends of the vertical axis are 0.323 [g/cm$^2$] and −0.381 [g/cm$^2$], respectively. The horizontal axis represents the positions of the measuring points, and the 206th and 286th measuring points are shown at the left and right ends, respectively. The downward convex curve indicates kernel $h_{m,n}(x)$ of the integration conversion when n=249 and m=14. In this case, since the actual value of deviation curve B(13,J) of the weight profile has two peaks in positions which are apart from the point corresponding to the peak position n=249 on both sides thereof by a width of substantially 10 measuring points, the interference coefficient increases toward two peaks at positions which are apart from the peak position n=249 by one slice width.

In the foregoing embodiment, $2\times3^{-1/2}\times\pi^{-1/4}$ has been substituted for coefficient $k_h$ in equation (23). The purpose is to perform normalization as shown below:

$$\int_{-\infty}^{+\infty}[h(x)]^2dx = 1 \tag{27}$$

Hence, the invention is not limited thereto, and the relationship between maximum value BMAX and the threshold value $V_0$ can be appropriately set depending on how the coefficient $k_h$ is defined.

Figure 14:
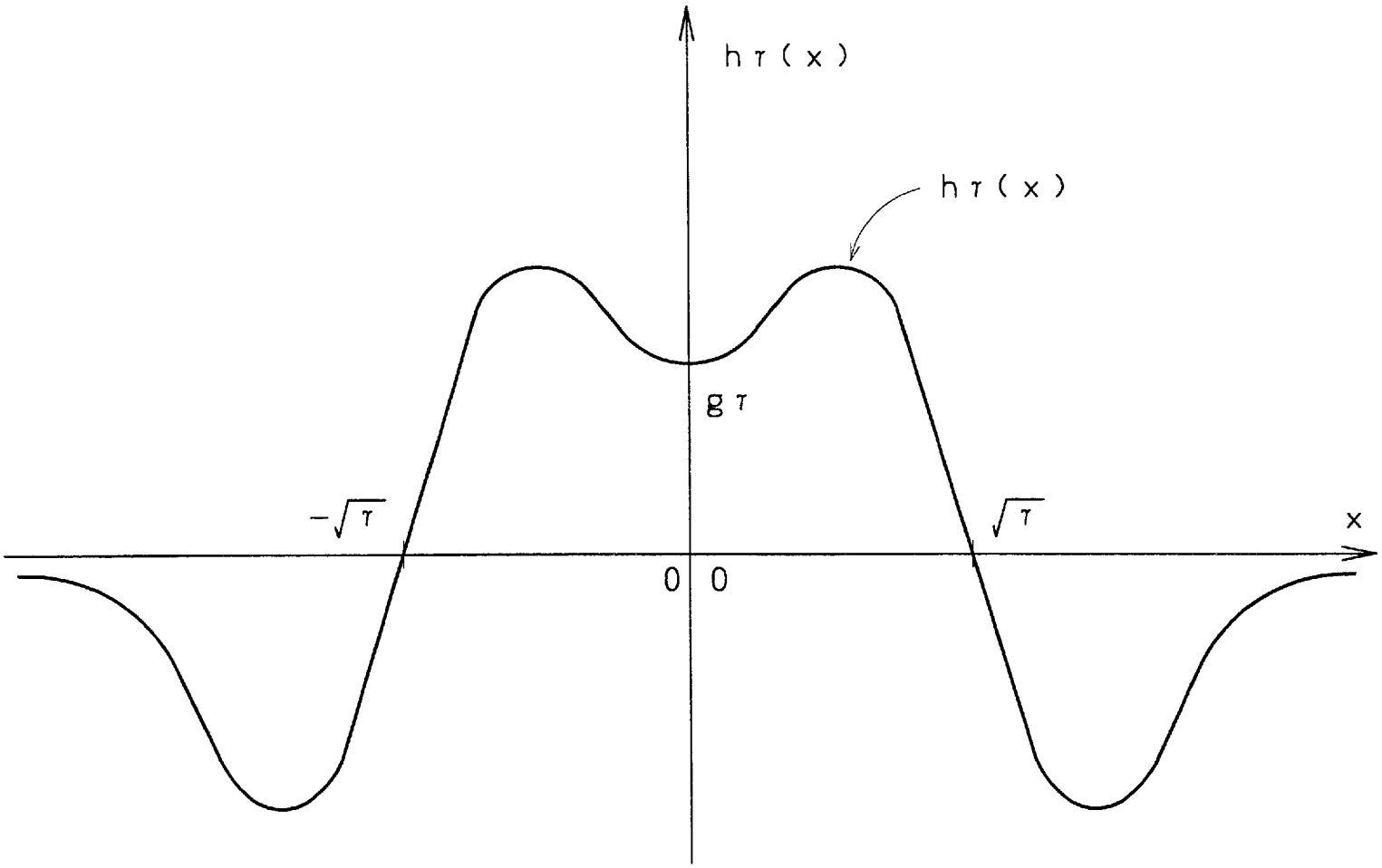
FIG. 14 is a diagram depicting an example of a kernel function h(x) of integrating coversion.

FIG. 14 is a functional diagram showing another example of kernel $h_{m,n}(x)$. As known from the definition of wavelet conversion, the kernel $h_{m,n}(x)$ of the integration conversion may be any function as long as it satisfies below equation (28).

$$\int_{-\infty}^{+\infty}h(x)dx = 0 \tag{28}$$

However, for profile control in a paper machine wherein the width of a slice must be taken into consideration, it is preferably a function which is localized in a range on the order of the width of the slice about a peak position variable. Also, it is preferably symmetrical about the peak position to be consistent with the physical phenomena. Then, the use of kernel function hr(x) having two peaks as shown in FIG. 14 will provide convergence in the peak position detection, similar to that obtained with equation (23).

$$Hr(x)=(x^2+q)\times(r-x^2)\times\exp(-x^2/2) \tag{29}$$

wherein 3½<r<3 and q=(3−r)/(r−1). A minimum value qr is obtained when x=0, and the zero point is given by x=±r½.

Figure 15:
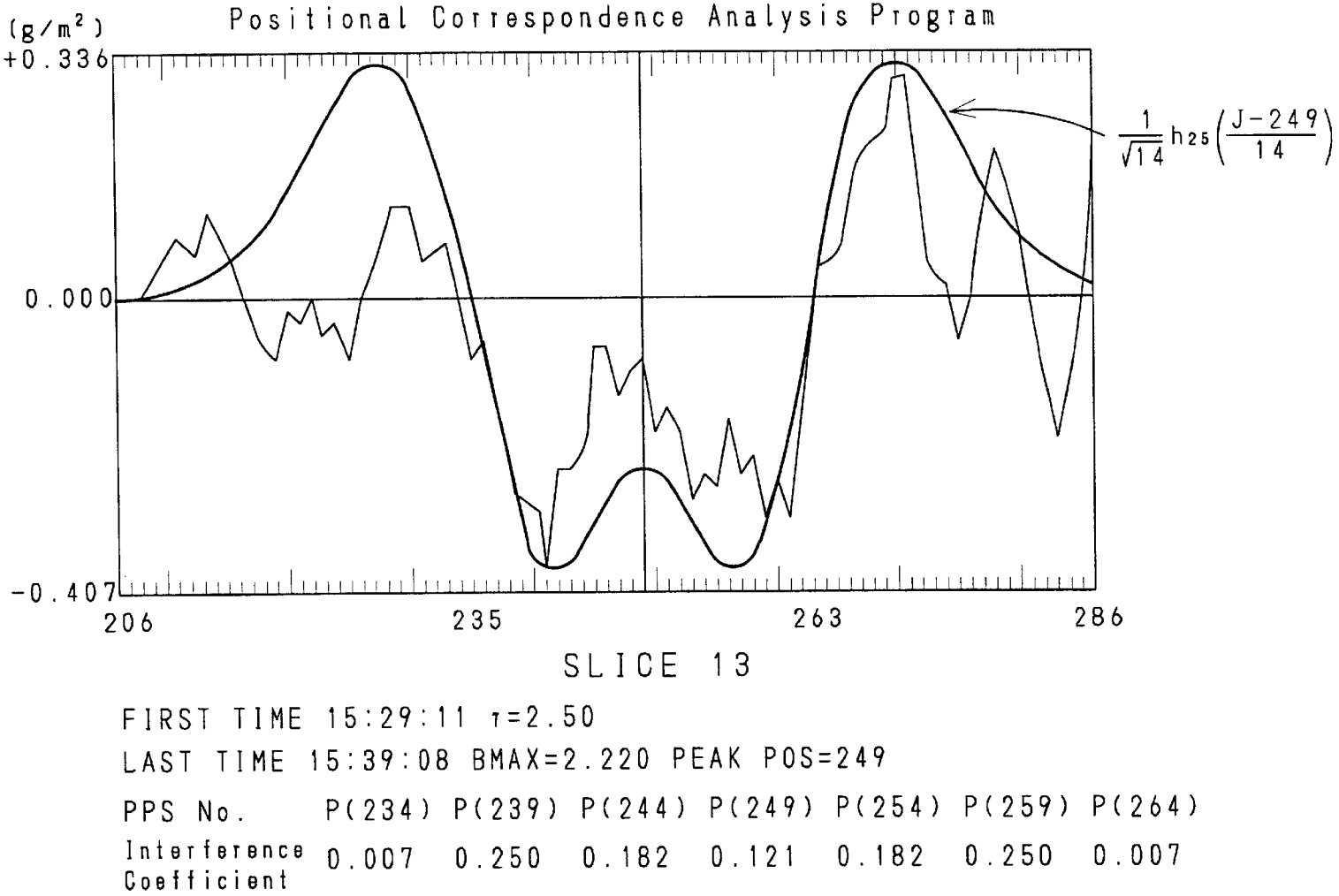
FIG. 15 is a diagram depicting positional correspondence analysis using kernel function h(x).

FIG. 15 shows positional correspondence analysis using kernel function hr(x) wherein a slice is operated in the direction of decreasing weight of paper. In FIG. 15, the zigzag shaped curve B(13,J) indicates deviations of weight profile and is the same as the curve in FIG. 13. In this case, r=2.50, and maximum value BMAX of WB(l,m,n) calculated by wavelet conversion is 2.220. The point corresponding to the peak position n=249 is similar to that of FIG. 4. The concavoconvex curve represents kernel hr(x) of integration conversion when n=249 and m=14. The two peaks of kernel function hr(x) itself provide higher conformity than in the case of FIG. 13.

According to the second aspect of the invention, deviations of the profile are subjected to wavelet conversion using a function, which is localized in a range on the order of the slice width about a peak position variable,as the kernel function hr(x). Positional correspondence is determined to identify the positions of the measuring points, which are affected by operations on an operated end, such as a slice, and the expanse of such an effect. This provides a practical advantage in that it can be applied to actual profile control in a paper making process with desired results. Thus,even if certain paper making functions are not clear during start up, since positional correspondence can be quickly determined, even an unskilled operator can take proper action.

Figure 10:
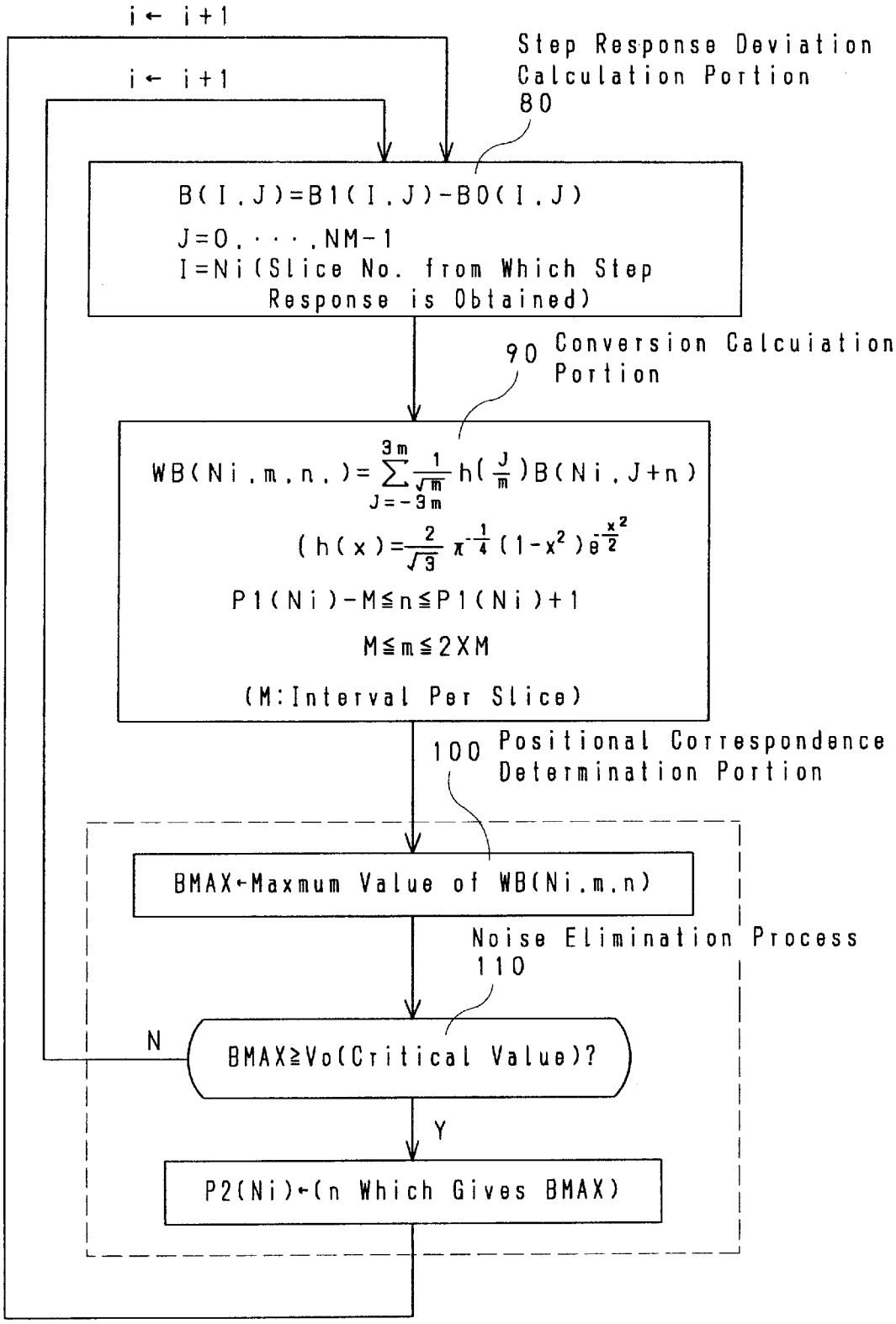
FIG. 10 is a block diagram depicting another illustrative embodiment of the second aspect of the invention.
Figure 16:
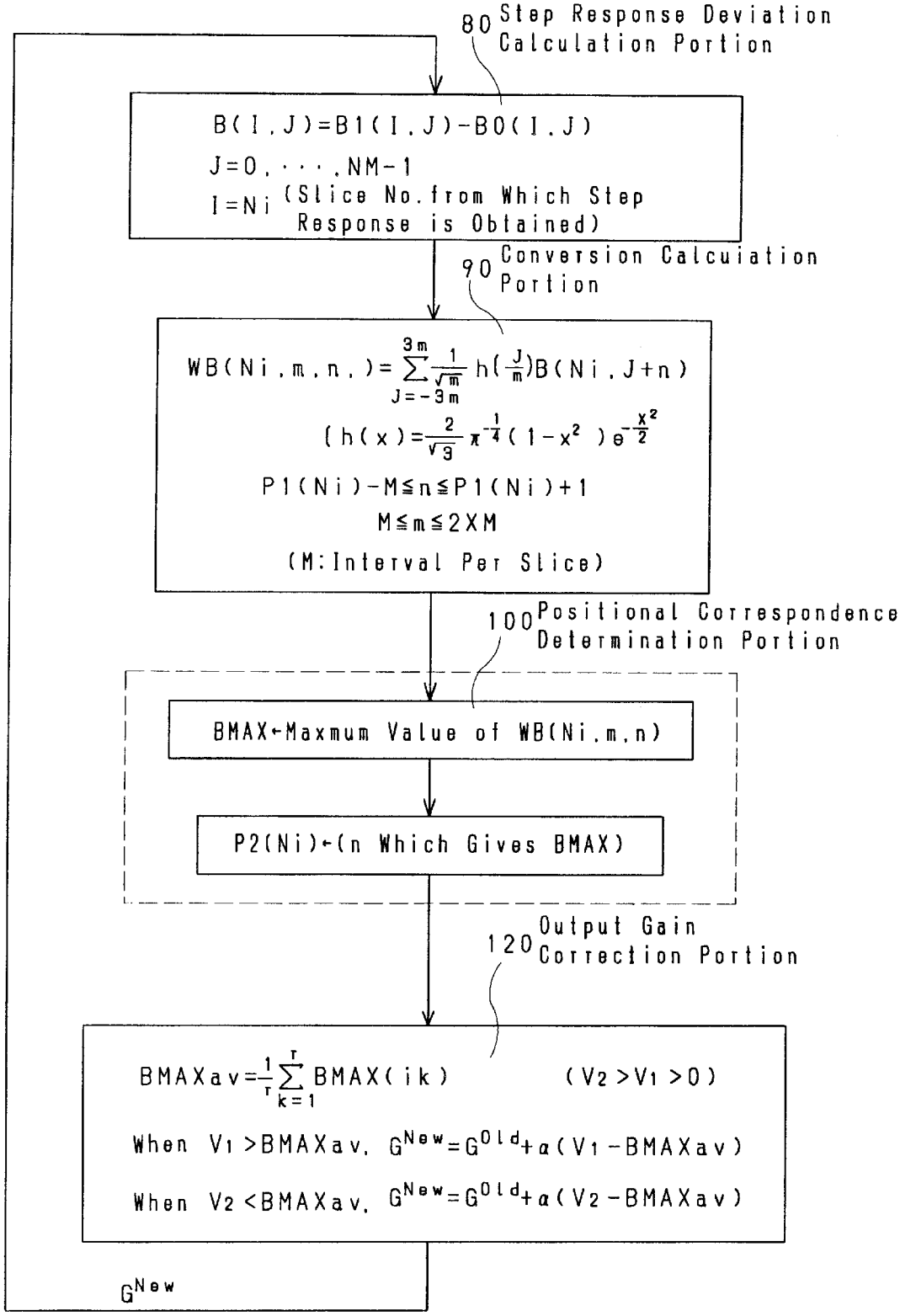
FIG. 16 is a diagram depicting an illustrative embodiment of the third aspect of the invention.

The third aspect of the invention will now be described with reference to FIG. 16, wherein parts having the same functions as those in FIG. 10 are indicated by like reference symbols and such parts will not be described hereat for sake of clarity of description. In FIG. 16, the positional correspondence determination portion 100 calculates value WB(I, m,n) of the wavelet conversion for a step response B(I, J+n)=−3m to +3m) for the slice I with values "m" and "n" being varied. If values "m" and "n", which provide a maximum value BMAX are determined, it can be considered that such value "n" provides a peak position of the step response. It can also be considered that the value "m" at that time provides the expanse of the step response. Consequently, the positional correspondence of the I-th operated end obtained from the step response is P2(I).

The output gain correction portion 120 compares the maximum value BMAX, obtained by portion 100, with an upper threshold value $V_2$ and a lower threshold value $V_1$, and then, decreases gain G of the operation output of the operated end when the maximum value BMAX is equal to or greater than the upper threshold value $V_2$, and on the hand, increases the gain G when the maximum value BMAX is equal to or smaller than the lower threshold value $V_1$. In this manner, the maximum value BMAX is corrected so as to be between the two theshold values $V_1$ and $V_2$.

Specifically, the calculations are performed as follows: Assume that the number of slices from which the step responses have been obtained at this time are i1, i2, . . . , ir. Then, the average maximum value $BMAX_{Av}$ is obtained as follows:

$$BMAX_{Av}=r_{k=1}\Sigma BMAX(ik)/r \tag{30}$$

The following calculation is performed when lower, threshold value $V_1>BMAX_{Av}$;

$$G^{new}=G^{old}+\propto(v_1-BMAX_{Av}) \tag{31}$$

Teh following calculation is performed when upper threshold value $V_2<BMAX_{Av}$:

$$G^{new}=G^{old}+\propto((V_2-BMAX_{Av}) \tag{32}$$

In equations 31 and 32, ∝represents an adjustment coefficient; $G^{old}$ represents the output gain at the time of the step response; and $G^{new}$ represents the output gain after correction.

In the foregoing manner, the output gain G is optimized. Maximum value BMAX of WB(I,m,n) can sometimes be smaller than a significant threshold value $V_0$, which is smaller than the lower threshold value $V_1$. In such a case, the data is preferably eliminated on the assumption that noise and disturbances to the process have prevented the peak position from being properly detected.

According to the third aspect of the invention, portion 120 adjusts the output gain so that the value calculated by wavelet conversion will lie between the upper threshold value $V_2$ and the lower threshold value $V_1$. As a result, the operated end can be operated in an optimal manner without either too large an output gain, which resuls in loss of paper or too small an output gain, which causes deviation of the profile to be hidden by noise or disturbances and prevents attaining of useful measured values.

Figure 17:
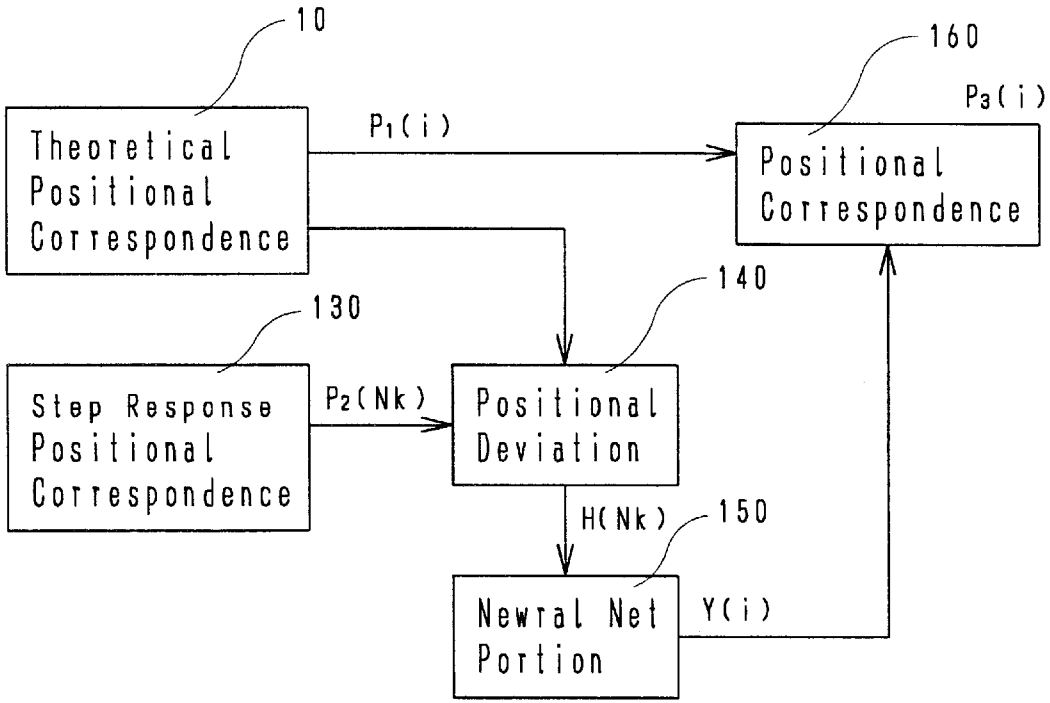
FIG. 17 is a diagram depicting an illustrative embodiment of the fourth aspect of the invention.

The fourth aspect of the invention will now be described with reference to FIG. 17, wherein theoretical positional correspondence portion 10 calculates theoretical positional correspondence $P_1(i)$ determined by contraction of paper, such as a result of drying during transport of the paper from the slices of the paper machine to the measuring positions of the sensors. The theoretical positional correspondence may be calculated on the assumption that contraction is uniform and has an overall contraction coefficient $\propto$. For example, the calculation may be performed on the assumption that contraction coefficient is large at the ends of the paper and smaller at the center thereof. The step response positional correspondence calculation portion 130 determines positional correspondence $P_2(Nk)$ at a step response from the deviation of values measured at a particular operated end I before and after operation on the detected end, and normally tests about one third of the entire group of slices. The positional correspondence deviation calculation portion 140 determines deviation H(Nk) of positional correspondence at a step response from the results of calculation at portion 10 and at portion 130.

Figure 18:
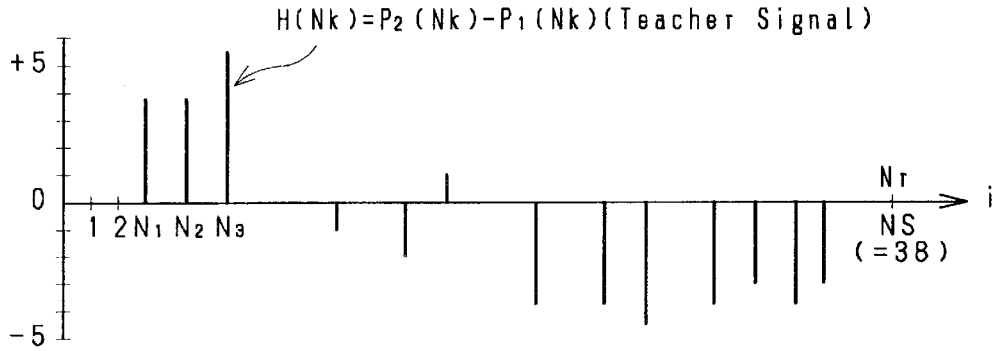
FIG. 18 is a diagram depicting deviation of positional correspondence H(Nk).

FIG. 18 shows the deviation of positional correspondence H(Nk) wherein slices $N_1, N_2, \ldots, N_r$ associated with the step response are shown on the horizontal axis in accordance with their positions in the direction of the width of the paper. The deviation of positional correspondence H(Nk) is defined by the following equation (33) as the deviation between theoretical positional correspondence $P_1(Nk)$, determined on the assumption that contraction is uniform, and the positional correspondence $P_2(Nk)$,at the step response.

$$H(Nk)=P_2(Nk)-P_1(Nk) \tag{33}$$

wherein k=1,2, . . . ,r.

Returning to FIG. 17, the deviation of positional correspondence H(Nk) is inputted to neural net portion 150 which in turn outputs the deviation through intermediate layers in an amount "m" determined by the total number of slices NS; and performs conversion on the input function using predetermined weight coefficients ($w_j^1$, $w_j^0$, and $v_j$(j=0,1, . . . , m) and sigmoid function $\tau_T(x)$ to obtain a most probable positional correspondence deviation function Y(i) which results in minimized error to the deviation of positional correspondence H(Nk). The most probable positional correspondence calculation portion 50 corrects the theoretical positional correspondence $P_1(i)$ using the output most probable positional correspondence deviation function Y(i) to obtain the most probable positional correspondence $P_3(i)$, that is:

$$P_3(i)=P_1(i)+Y(i) \tag{34}$$

where in i=1,2, . . . , NS.

Figure 19:
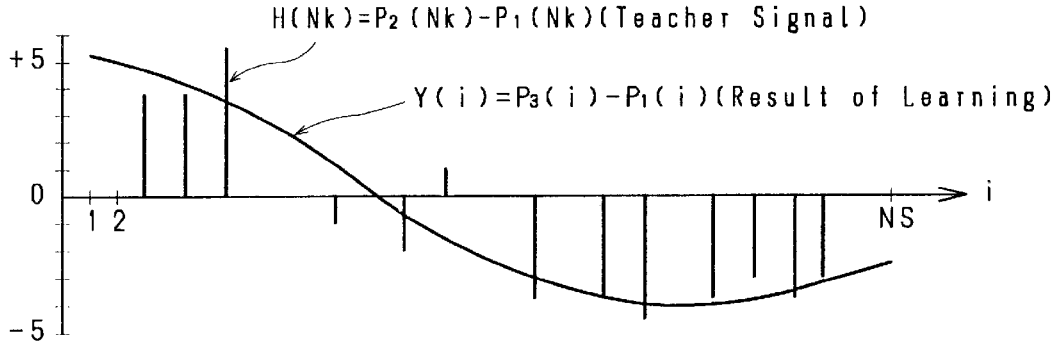
FIG. 19 is a diagram depicting a most probable position correspondence deviation function (Yi) determined by the deviation of positional correspondence H(Nk).

FIG. 19 shows the most probable positional correspondence deviation function Y(i), determined by deviation of positional correspondence H(Nk), wherein slices $N_1, N_2, \ldots, N_r$ associated with the step response are shown on the horizontal axis in accordance with their positions in the direction of the width of the paper. The deviation function Y(i) must satisfy the following two conditions:

(1) $Y(N_1), \ldots, Y(N_r)$ approximate deviations $H(N_1), \ldots, H(N_r)$ at the step response as closely as possible.

(2) The transition between y(1), Y(2), . . . ,Y(NS) occurs smoothly. For such purpose,an appropriate function Y(i) is obtained by using a neural network having three layers and causing the neural network to learn the weight function through back propagation using the deviation of positional correspondence H(Nk) at the step response as a teacher function.

Figure 20:
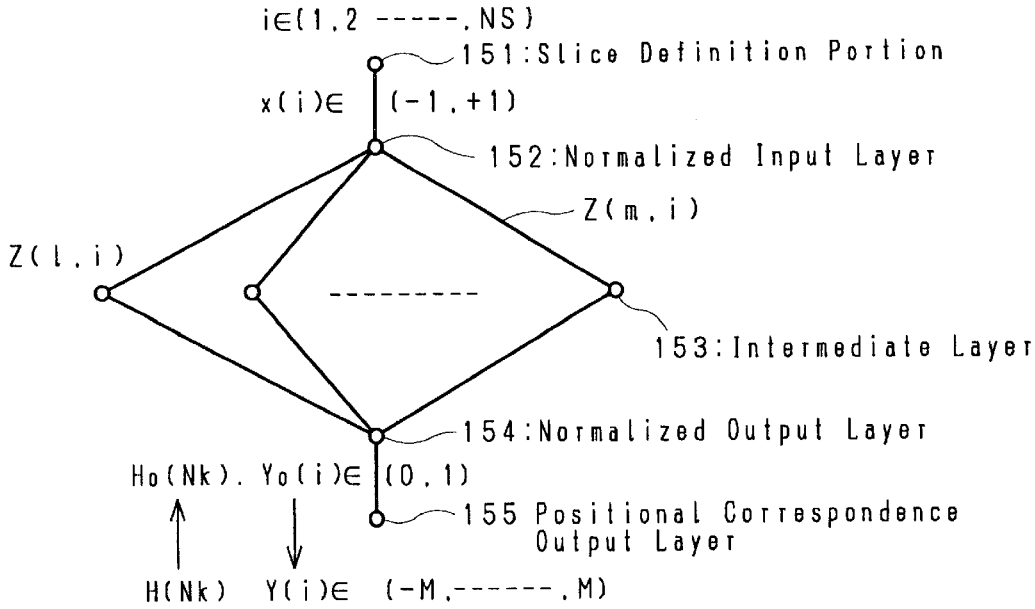
FIG. 20 is a view depicting a neural net portion.

FIG. 20 shows details of the neural network portion 150 comprising a neural network having three layers. The sigmoid function $\tau_T(x)$ which is used in the neural network is as follows:

$$\tau_T(x)=1/[1+\exp(-1/T)] \tag{35}$$

wherein x is a real number and T is a positive real number. The function Y(i) is represented as a neural network having three layers, i.e. one input layer, one output layer, and "m" intermediate layers. It should be noted that the following equation (36) is obtained by differentiating the sigmoid function $\tau_T$ (x):

$$d\tau_T(x)/dx=T^{-1}\times\tau_T(x)\times[1-\tau_T(x)] \tag{36}$$

The slice definition portion 151 defines which ones of the slices 1,2, . . . , NS corresponds to the particular slice I associated with the step response. A normalization input layer 152 normalizes the particular slice i(i=1,2, . . . , NS) to [−1,1] and defines the coefficient map X(i),shown below:

$$X(i):=[2\cdot i-NS-1]/(NS-1) \tag{37}$$

wherein i=1,2, . . . , NS, and ":" means that X(i) on the left side is defined by the right side. In this case, X(i)=−1, and X(NS)=1.

The intermediate layer 153 is provided in a quantity "m" which is in the range from one half to one third of the total number of slices. A map Z(j,i) from the input layer 152 to the intermediate layer 153 is defined by the following:

$$Z(j,i):=\tau_T(w_j^1\cdot X(i)+W_j^0) \tag{38}$$

wherein weight coefficients $w_j^1$ and $w_j^0$ are real numbers; i=1,2, . . . , NS, and j=0,1, . . . , m.

Normalization output layer 154 has a value normalized to [0,1]. A map $Y_0(i)$ from intermediate layer 153 to output layer 154 is defined as follows:

$$Y_0(i):=\tau_1(V_0+j=1^m\Sigma v_j\cdot Z(j,i) \tag{39}$$

wherein weight coefficients $V_0, V_1, \ldots, V_m$ are real numbers.

A positional correspondence output layer 155 places the value of normalization output layer 154 in correspondence with the position correspondence function. The deviation of the positional correspondence function H(Nk) serves as a function teacher for the neural network with the most probably deviation function Y(i) being the result of the learning. Since there is almost no possibility that functions H(Nk) and Y (i) deviate in an amount equal to or greater than one slice, the ranges of these functions are defined as

[−M, . . . , 0, . . . , +M]

wherein M indicates the width of the measuring points corresponding to one slice in terms of the number of measuring points. For example, if there are 36 slices and 360 measuring points, then M will be 10. in order to put the value range [−M, . . . , 0, . . . , +M] in correspondence with the output layer [0,1] of the neural net, the following maps are defined:

$$H_0(i)=(0.3/M)\cdot H(i)+0.5 \tag{40}$$

$$Y(i)=[Y_0(i)-0.5]/(0.3/M) \tag{41}$$

Then, the following relationships are established:

When $Y_0(i)=0.2$, then $Y(i)=-M$

When $Y_0(i)=0.8$, then $Y(i)=+M$

When $H_0(i)=0.2$, then $H(i)=-M$

When $H_0(i)$ is 0.8, then $H(i)=+M$.

The output layer of the neural net is limited to 0.2 to 0.8 because the differentiating coefficient (see equation 32) of the signmoid function $\tau_T(x)$ has a substantially constant value (which may be equal to ¼ T) and that the differenting coefficient (see equation 36) for the region near 0,1 at both ends of the region [0,1] is substantially 0, which is not suitable for mapping. A square error $E_0$ of the neural network is given by the following equation:

$$E_0:=(2r)^{-1}k=1'\Sigma[Y_0(Nk)-H_0(Nk)]^2 \tag{42}$$

By appropriately selecting coefficient T in the sigmoid function $\tau_T(x)$, an arrangement can be made such that when the square error $E_0$ is minimized, the most probable deviation function Y(i) can be obtained which satisfies the above conditions (1) and (2), which may seem contradictory,in appropriate balance. The rules for learning for obtaining coefficients $w_j^1$, $w_j^0$, and $v_j$ which minimize the square error $E_0$ can be provided using the minimum dive method, as discussed below. First, in order to obtain the optimum value of the coefficient $v_j$, the square error $E_0$ is subjected to partial differentiation using coefficient $v_j$ as shown by the following equation:

$$\frac{\partial E_0}{\partial vj}=\frac{1}{r}\sum_{k=1}^{r}\left([Y_0(Nk)-H_0(Nk)]\cdot\frac{\partial}{\partial v_j}(Y_0(Nk)\right)= \tag{43}$$

$$\frac{1}{r}\sum_{k=1}^{r}\left([Y_0(Nk)-H_0(Nk)]\cdot\frac{\partial}{\partial v_j}\tau_1\left(v_0+\sum_{j=1}^{m}V_jZ(j,Nk)\right)\right)$$

The minimum dive method is a method of calculation wherein the square error $E_0$ is partially differentiated by the coefficient $v_j$ and the differentiating coefficient is corrected by multiplying it by a predetermined constant ΔThe detailed calculation of the terms of the partial differentiation on the right side of equation (43) is as follows:

$$\frac{\partial}{\partial v_j}\tau_1\left[v_0+\sum_{j=1}^{m}v_j\cdot Z(j,Nk)\right] \tag{44}$$

$$Y_0(Nk)[1-Y_0(Nk)]\frac{\partial}{\partial v_j}\left[v_0+\sum_{j=1}^{m}V_j\cdot Z(j,Nk)\right]=$$

$$Y_o(Nk)[1-Y_o(Nk)]Z(j,Nk)$$

wherein Z(0,Nk)=1, and j=o,1, . . . , m. Also, the following relation is established:

$$d[\tau_1(x)]/dx=\tau_1(x)[1-\tau_1(x)] \tag{45}$$

Hence, the following equation can be derived by substituting equation (44) into equation (43):

$$\frac{\partial E_0}{\partial V_j}=\frac{1}{r}\sum_{k=1}^{r}([Y_0(Nk)-H_0(Nk)]Y_0(Nk)[1-Y_0(Nk)]Z(j,Nk)) \tag{46}$$

wherein j=0,1, . . . , m.

To simplify equation 46, a coefficient $D_2$, k is defined as follows:

$$D_2,k:=[Y_0(Nk)-H_0(Nk)]\times Y_0(Nk)\times[1-Y_0(Nk)] \tag{47}$$

wherein k=1,e, . . . , r.

Then equation (46) can be changed as follows:

$$\frac{\partial E_0}{\partial V_j}=\frac{1}{r}\sum_{k=1}^{r}[D_2\cdot k\cdot Z(j,Nk)] \tag{48}$$

wherein j=0,1, . . . ,m.

Next, in order to obtain the optimum value of coefficient $W_j^1$, the square error $E_0$ is subjected to parial differentiation using coefficient $W_j^1$, which results in the following equation:

$$\begin{aligned}\left[\frac{\partial E_0}{\partial W_j^1}\right.: &= \frac{1}{r}\left([Y_0(Nk)-H_0(Nk)]\frac{\partial}{\partial w_j^1}(Y_0(Nk))\right) \\ &= \frac{1}{r}\sum_{k=1}^{r}([Y_0(Nk)-H_0(Nk)] \\ &\quad x\frac{\partial}{\partial w_j^1}\tau_1\left(v_0+\sum_{j=1}^{m}v_j\cdot\tau_T(w_j^1x(Nk)+w_j^0)\right)\Bigg) \\ &= \frac{1}{r}\sum_{k=1}^{r}([Y_0(Nk)-H_0(Nk)] \\ &\quad xY_0(Nk)[1-Y_0(Nk)]V_j\frac{\partial}{\partial W_j^1}\tau_T(W_j^1x(Nk)+W_j^o)\Bigg) \\ &= \frac{1}{r}\sum_{k=1}^{r}\left[D_{2,k}\cdot V_j\frac{\partial}{\partial W_j^1}\tau_T(W_j^1x(Nk)+W_j^0)\right] \\ &= \frac{1}{r}\sum_{k=1}^{r}\left(D_{2,k}\frac{V_j}{T}\cdot Z(j\cdot Nk)[1-Z(j\cdot Nk)]x(Nk)\right)\end{aligned} \tag{49}$$

Similarly, the square error $E_0$ is subjected to partial differentiation using coefficient $W_j^0$,which results in the following:

$$\frac{\partial E_0}{\partial W_j0}=\frac{1}{r}\sum_{k=1}^{r}\left[D_{2,k}\cdot\frac{V_j}{T}\cdot Z(j,Nk)(1-Z(j,Nk))\right] \tag{50}$$

To simplify equation (50), a coefficient $D_{1,j,k}$ is defined as follows:

$$D_{1,j,k}:=D_{2,k}\times V_j\times Z(j,Nk)\times[1-Z(j,Nk)] \tag{51}$$

wherein k=1,2, . . . , r.

Then, equation (50) can be changed to be as follows:

$$\frac{\partial E_0}{\partial W_j1}=\frac{1}{rT}\sum_{k=1}^{r}[D_{1,j,k}\times(Nk)] \tag{52}$$

$$\frac{\partial E_0}{\partial W_j0}=\frac{1}{rT}\sum_{k=1}^{r}D_{1,j,k} \tag{53}$$

wherein j=1,2, . . . , m.

Therefore, the corrected values of the coefficient $W_j^1$ and $W_j^l$, and $V_j$ (wherein j=0,1, . . . , m) according to the minimum dive method, are as follows:

$$\begin{aligned}V_j^{new}: &= V_j^{old}-\Delta\cdot\frac{\partial E_0}{\partial V_j} \\ &= V_j^{old}-\frac{\Delta}{r}\sum_{k=1}^{r}[D_{2,k}\cdot Z(j,Nk)]\end{aligned} \tag{54}$$

wherein j=0, 1, . . . , m.

$$\begin{aligned}W_j^{1new}: &= W_j^{1old}-\Delta\frac{\partial E_0}{\partial W_j^1} \\ &= W_j^{0old}-\frac{\Delta}{rT}\sum_{k=1}^{r}D_{1,j,k}\end{aligned} \tag{56}$$

wherein j=1,2, . . . , m.

Δ is a positive constant and is the same for each of equations 54,55, and 56.

The foregoing operations will now be described with reference to specific examples, such as shown in FIG. 21 which shows the case wherein the total number of slices is 38 and the step responses are as shown in FIG. 18. The positional correspondence $P_1(i)$, the positional correspondence $P_2(i)$ at the step responses, a most probable positional correspondence deviation function Y(i), and most probable positional correspondence $P_3(i)$ are shown for each of slices (i) 1 through 38. For the slices, on which the step response has not been tested, the column for positional correspondence $P_2(i)$ is left open. The column for deviation H(i) of positional correspondence is also left open for the slices on which no step response has been performed. The results of the learning of the most probable positional correspondence deviation function Y(i) is calculated even for the slices on which no response has been performed. In this case, the positional correspondence is obtained for 13 slices. For example, slice No. 3 has a deviation of positional correspondence H(3)=+4 because $P_1(3)=346$ and $P_2(3)=350$. Also, it has a most probable positional deviation function Y(3)=+5, and most probable positional correspondence $P_3(3)=351$.

For example, the inital values of coefficient $W_j^1$, $W_j^0$, and $V_j$ (wherein j=0,1, . . . ,m) are defined as follows, with the number "m" of the intermediate layer 153 being 14:

| | |
|---|---|
| $w_1^0 = 0$; $w_1^1 = 1$;, | $w_2^0 = 0$; $w_2^1 = -1$; |
| $w_3^0 = -1/3$; $w_3^1 = 1$; | $w_4^0 = 1/3$; $w_4^1 = -1$; |
| $w_5^0 = -1/3$; $w_5^1 = -1$; | $w_6^0 = 1/3$; $w_6^1 = 1$; |
| $w_7^0 = -2/3$; $w_7^1 = 1$; | $w_8^0 = 2/3$; $w_8^1 = -1$; |
| $w_9^0 = -2/3$; $w_9^1 = -1$; | $w_{10}^0 = 2/3$; $w_{10}^1 = 1$; |
| $w_{11}^0 = -3/3$; $w_{11}^1 = 1$; | $w_{12}^0 = 3/3$; $w_{12}^1 = -1$; |
| $w_{13}^0 = -3/3$; $w_{13}^1 = -1$; | $w_{14}^0 = 3/3$; $w_{14}^1 = 1$; |
| $v_0 = -1.4$; $v_1 = v_2 = \ldots = v_{14} = 0.2$ | |

This results in an intial value of $Y_0(i)$ as follows;

$$\begin{aligned} Y_0(i) &= \tau_1\left(v_0 + \sum_{j=1}^{14} v_j \cdot z(j,i)\right) \\ &= \tau_1\left(-1.4 + 0.2\sum_{j=1}^{14} z(j,i)\right) \\ \tau_1(0) &= 0.5 \end{aligned} \tag{57}$$

This is because the following relationship holds:

$$\begin{aligned} Z(1,i) + Z(2,i) &= \frac{1}{1+e^{-x(i)}} - \frac{1}{1+e^{x(i)}} \\ &= \frac{1+e^{x(i)}+1+e^{-x(i)}}{(1+e^{-x(i)})(1+e^{x(i)})} \\ &= 1 \end{aligned} \tag{58}$$

Furthermore, if the initial value of $Y_0(i)$ is substituted into equation (41), the initial value of Y(i) becomes 0, that is:

$$Y(i)=[Y_0(i)-0.5]/(0.3/M)=0.0 \tag{59}$$

Figure 22:
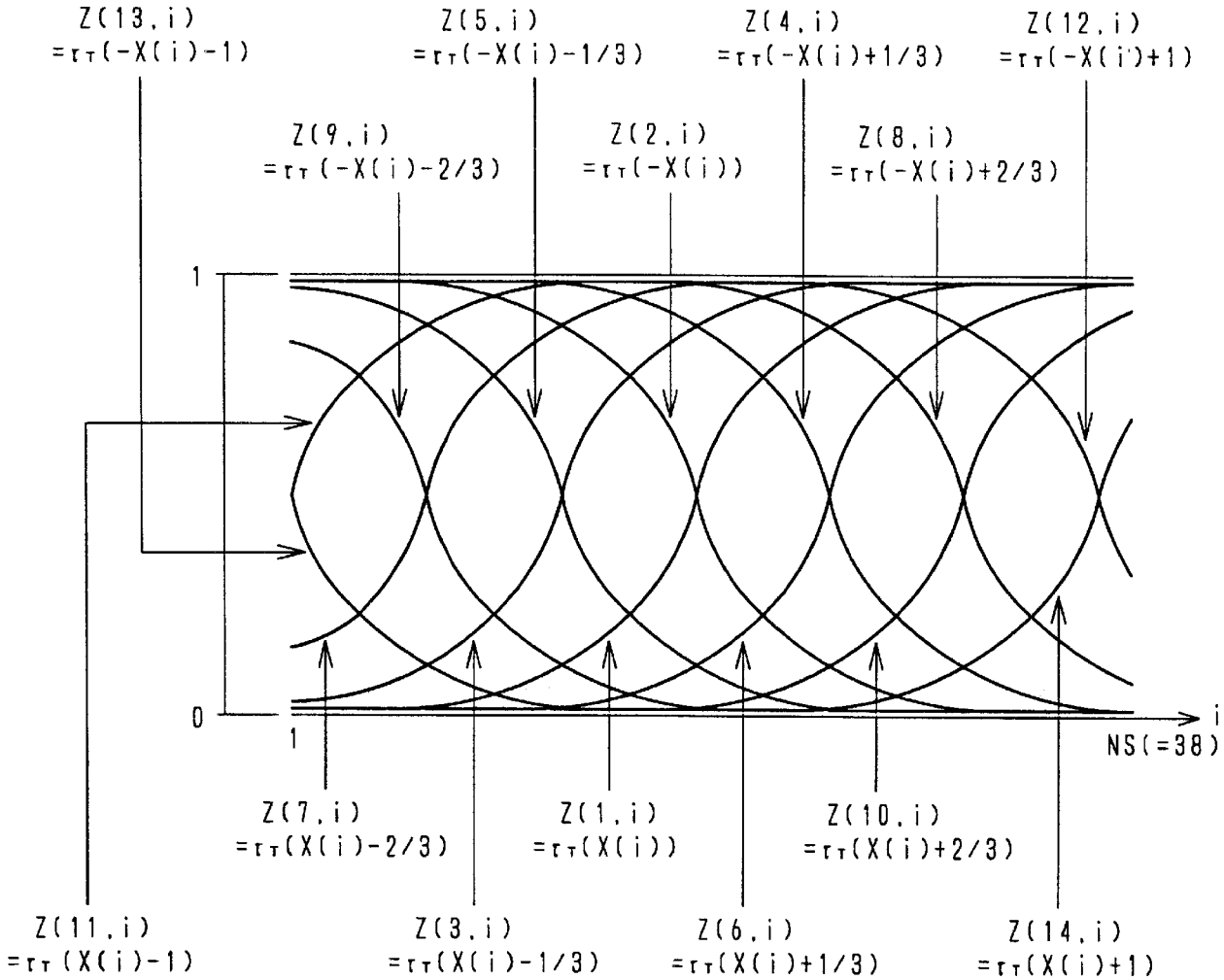
FIG. 22 is a diagram depicting initial values of a map Z(j,i) from an input layer to an intermediate layer.

FIG. 22 shows the initial value of a map Z(j,i) from an input layer 42 to an intermediate layer 43 wherein the horizontal axis is normalized to slices i=1–NS and the vertical axis is normalized to 0 to 1. For example, Z(1,i) is as follows, using equation (38):

$$Z(1,i)=\tau_T(W_1^1 \cdot X(i)+W_1^0)=\tau_T(X(i)) \tag{60}$$

After 100 cycles of learning, at portion 150, with Δ=5 and T=0.2, the following were obtained as a result of convergence:

| | |
|---|---|
| $w_1^0 = -0.029$; $w_1^1 = 0.990$; | $w_2^0 = -0.074$; $w_2^1 = -1.018$; |
| $w_3^0 = -0.404$; $w_3^1 = 0.990$; | $w_4^0 = 0.215$; $w_4^1 = -1.027$; |
| $w_5^0 = -0.393$; $w_5^1 = -1.016$; | $w_6^0 = 0.333$; $w_6^1 = 0.992$; |
| $w_7^0 = -0.658$; $w_7^1 = 1.032$; | $w_8^0 = 0.668$; $w_8^1 = -0.976$; |
| $w_9^0 = -0.590$; $w_9^1 = -1.097$; | $w_{10}^0 = 0.707$; $w_{10}^1 = 0.966$; |
| $w_{11}^0 = -0.968$; $w_{11}^1 = 1.030$; | $w_{12}^0 = 1.025$; $w_{12}^1 = -0.976$; |
| $w_{13}^0 = -0.912$; $w_{13}^1 = -1.062$; | $w_{14}^0 = 1.036$; $w_{14}^1 = 0.975$; |
| $v_0 = -1.377$; $v_1 = 0.069$; | $v_2 = 0.368$; $v_3 = 0.219$; |
| $v_4 = +0.245$; $v_5 = 0.427$; | $v_6 = 0.001$; $v_7 = 0.280$; |
| $v_8 = +0.144$; $v_9 = 0.413$; | $v_{10} = 0.054$; $v_{11} = 0.242$; |
| $v_{12} = +0.188$; $v_{13} = 0.272$; | $v_{14} = 0.173$ |

Figure 23:
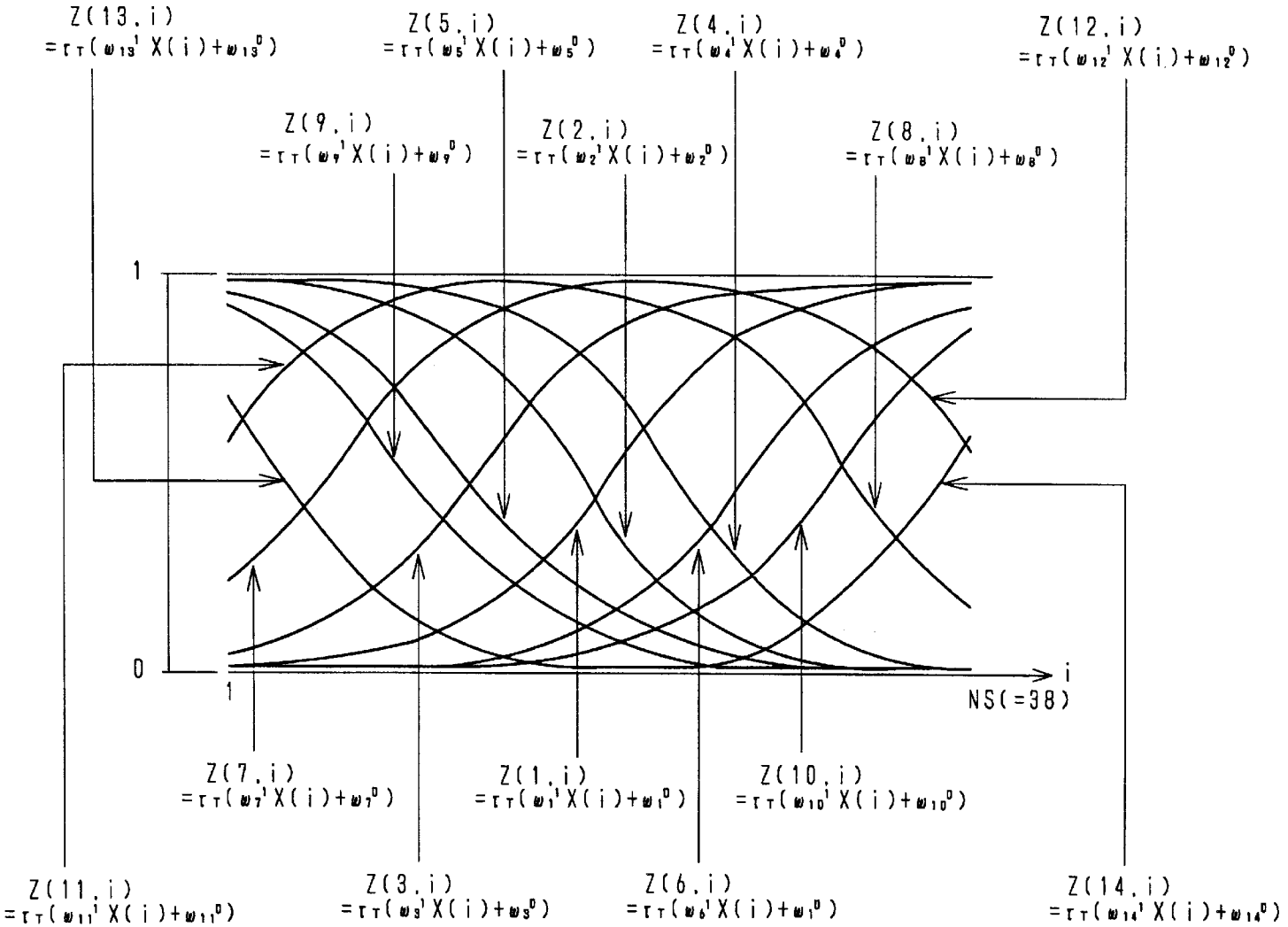
FIG. 23 is a diagram depicting convergent values of a map Z(j,i) from an input layer to an intermediate layer.

FIG. 23 shows the convergent values of a map Z(j,i) from an input layer 152 to an intermediate layer 153. For example, Z(1,i) is represented as follows, using equation (60):

$$Z(1,i)=\tau_T(W_1^1 \cdot X(i)+W_1^0)=\tau_T(0.990 \cdot X(i)-0.029) \tag{61}$$

With coefficients $w_j^1$, $w_j^0$, and $v_j$(j=0,1, . . . ,m) which have converged as described above, portion 150 provides a function Y(i) showing the results of the learning as shown in FIG. 19. The final most probably positional correspondence $P_3(i)$ is given by the following:

$$P_3(i)=Y(i)+P1(i) \tag{62}$$

As described above in accordance with the fourth aspect of the invention, the neural network obtain a most probable positional correspondence deviation using theoretical positional correspondence obtained by taking contraction of paper, such as due to drying, into consideration and the positional correspondence empirically determined from the step responses, thereby correcting the theoretical positional correspondence. Consequently, there is obtained high degree of conformity between the slices and the measuring points, and furthermore, the profile control is such as to produce a high quality paper with high speed.

The following two conditions which may contradict each other are items to be considered:

(1) $Y(N_1)$, . . . , Y(Nr) approximate as closely as possible the deviations $H(N_1)$, . . . , $H(N_r)$ at the step response.

(2) The transition between Y(1), Y(2), . . . , Y(NS) occurs smoothly. However, by appropriately selecting coefficient "T" in the sigmoid function $\tau_T(x)$, it is possible to cause the neural network to learn the weight functions through back propagation using the deviation of positional correspondence at the step response H(Nk) as a teacher function, thereby providing a most probable positional correspondence deviation function Y(i) which is adequate for practical use. This enables the operator to perform analytical operations so that changes, such as for brand name changes, can be performed quickly.

Figure 24:
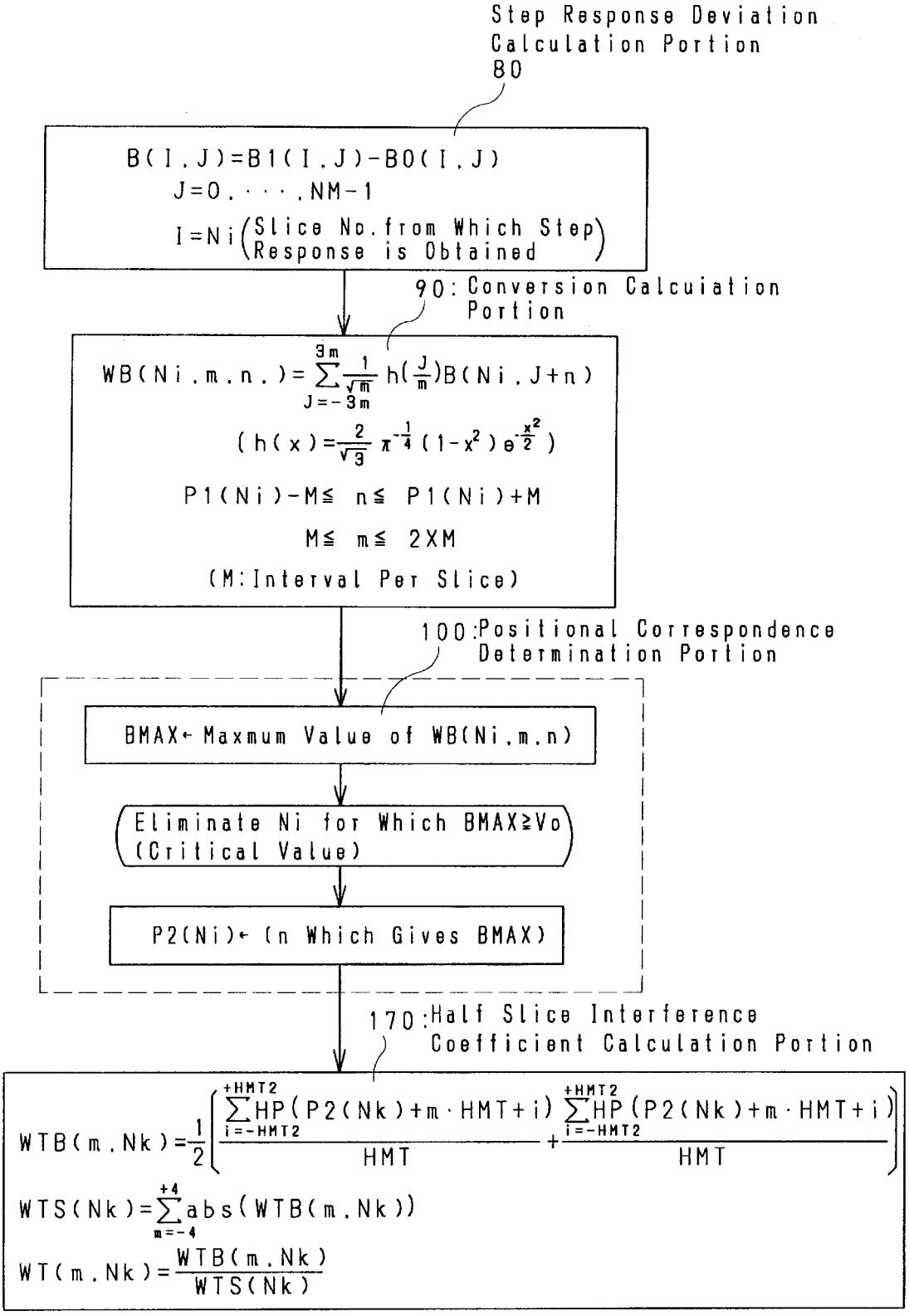
FIG. 24 is a diagram depicting another illustrative embodiment of the invention.

The fifth aspect of the invention will now be described with reference to FIG. 24, wherein parts having like functions as in FIG. 10 are indicated by like reference symbols and will not be further discussed hereat for sake of clarity of description. In FIG. 24, the half slice interference coefficient calculation portion 170 calculates interference coefficients for the operated ends in the vicinity thereof and half slice interference coefficients, for the operated ends for which the maximum value BMAX of WB(I,m,n) is equal to or greater than threshold value $V_0$. Assume that the operated end from which step responses have been obtained are represented by $N_1$, $N_2$, . . . , Nr; and that the number of neighboring half slices in the direction of the width of the paper to be averaged is represented by HMT. The number HMT of the half slices so averaged is an odd number. If integration is to be performed symmetrically in both the positive and negative directions including zero, it is convenient to define the following coefficient.

$$HMT2=(HMT-1)/2 \tag{63}$$

Then, the interference coefficient on a half slice basis WT(m,NK) is calculated as follows, wherein the positions "m" of the half slices relative to the operated ends operated at the step responses are −4 to +4, and wherein "k" represents the slices and assumes the values 1,2, . . . , r.

$$WTB(m,NK)=\frac{1}{2}\left[\frac{\sum_{i=-HMT2}^{+HMT2} HP(P_2(Nk)+m\cdot HMT+i)}{HMT}+\frac{\sum_{i=-HMT_2}^{+HMT2} HP(P_2(Nk)-m\cdot HMT+i)}{HMT}\right] \tag{64}$$

$$WTS(Nk)=\sum_{m=-4}^{+4} abs[WTB(m,Nk) \tag{65}$$

$$WT(m,Nk)=\frac{WTB(m,Nk)}{WTS(Nk)} \tag{66}$$

Specifically, the following relations hold for the interference coefficient on a half slice basis WT(m,Nk):

$$WT(m,Nk)=WT(-m,\ Nk) \tag{67}$$

$$+4_{m=-4}\Sigma abs[WT(m,Nk)]=1 \tag{68}$$

Thus, the interference coefficients are obtained for the operated end which provide significant step response among the operated end to which step responses have been requested.

FIG. 25 shows the sixth aspect of the invention which is connected to the components shown in FIG. 24. In FIG. 25, the process interference coefficient calculation portion 180 averages the interference coefficients WT(m,Nk) on a half slice basis,which coefficients were calculated on the half slice basis by portion 170 for the operated ends which provided step responses.

$$WTAB(m)=\max[('k=1\Sigma[WT(m,Nk)]/r,0] \tag{69}$$

$$WTS=^{+4}{}_{m=-4}\Sigma WTAB(m) \tag{70}$$

$$WTA(m)=WTAB(m)/WTS \tag{71}$$

Thus, the average interference coefficient on a slice basis WTA(m) where m=−4 to +4, is non-zero, and the following hold:

$$WTA(m)=WTA(-m) \tag{72}$$

$$+4_{m=-4}\Sigma WTA(m)=1 \tag{73}$$

The membership function calculation portion 190 calculates the membership function Fn,m(x) for each operational rule "n" using the average interference coefficient on a slice basis WTA(m). First, for an Operational Rule 1, when WTA(m)·x+1>0, the function is determined by the following:

$$F_{1,m}(x)=4\ \log\ [WTA(m)\cdot x+1] \tag{74}$$

Next for Operational Rule 2, when [WTA(m−1)+WTA(m+1) ·x/[0.6abs(m)+1]+1>0, the function is determined as follows:

$$F_2,m(x)=(4/1.3)\ \log[(WTA(m-1)+WTA(m+1)]/[0.6abs(m)+1]+1] \tag{75}$$

When [WTA(m−1)+WTA(m+1)]·X/[0.6abs(m)+1]+1<0, then $F_{2,m}$=−100.

For an Operational Rule 3, the membership function varies depending on whether the relative position m=0, indicating an operated end under step operation, or m≠0. When m=0, then if [WTA(m)·abs(x)]/5+1>0, then the function is determined as follows:

$$F_{3,1}(x)=(4/0.9)\ \log[(WTA(m)\cdot abs(x)/5+1] \tag{76}$$

If [WTA(m)·abs(x)]/5+1<0, then, $F_{3,1}{}^{(x)=-}$100. When m≠0, if [WTA(m+1)−WTA(m−1)]·x/[0.6abs(m)]+1>0, then the function is determined as follows:

$$F_{3,m}(x)=(4/0.9)\ \log[(WTA(m+1)-WTA(m-1)\cdot X/[0.6abs(m)+1]+1] \tag{77}$$

If [WTA(m+1)−WTA(m−1)]·X/[0.6abs(m)+1]+1<0,then $F_{3,m}$(x)=−100.

Figure 26A:
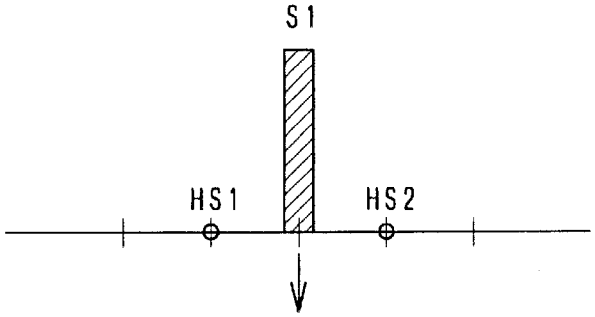
FIGS. 26(*a*), 26(*b*) and 26(*c*) are diagrams depicting an example of operational rules.
Figure 26B:
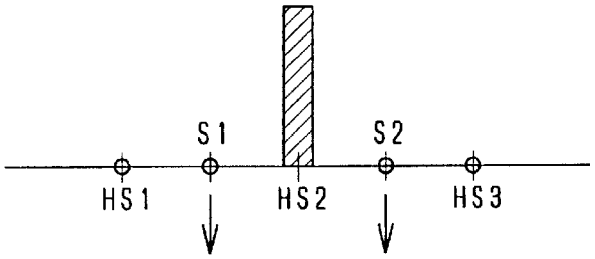
Figure 26C:
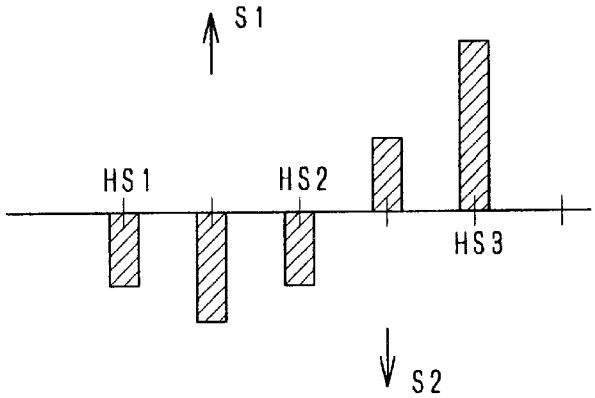

Operational Rules 1,2 and 3 will now be described with reference to FIGS. 26A, 26B and 26C, which show diagrams for explaining the three operational rules, such as disclosed in Japanese Unexamined Patent No. H4-2896. In FIGS. 26A–26C, S1 and S2 represent slices and HS1–HS3 represent half slices. A half slice is a virtual slice provided between slices which exist physically and is used to convert deviation between a set value and a measured value at the measuring point, into a data format suitable for operation of the slice by averaging the deviation for the slice and half slice in corresponding positions.

FIG. 26A shows Operational Rule 1 for operating one slice, which is effective for the case wherein only one slice has a deviation and half slices on both sides thereof having no deviation. According to Operational Rule 1, only the slice is operated in the direction of decreasing deviation. FIG. 26B shows Operational Rule 2 for operating two slices in the same direction, which is effective for the case wherein half slice HS2 in the middle has a deviation and the slices and half slices on both sides thereof have no deviation. According to Operational Rule 2, two slices S1 and S2 are operated in the same direction and the deviation of the half slice HS2 in the middle is decreased. FIG. 26C shows Operational Rule 3 for operating two slices in opposite directions, which is effective for the case wherein the sign of deviation of slices S1 and S2 on both sides change. According to Operational Rule 3, the two slices S1 and S2 are operated in opposite directions to decrease the deviation of each slice and each half slice. As disclosed in Japanese Unexamined Patent H5-59685, the number of Operational Rules can be increased by describing such rules more specifically.

In so doing, conformity A is used to indicate the degree of conformity of an object to be operated according to each of Operational Rules 1,2 and 3. Since conformity A is positive or zero in principle and cannot assume a negative value, MAX as shown below is used to prevent conformity A from becoming a negative value.

(1) Conformity at which the I-th operated end is lowered according to Operational Rule 1:

$$A(1,I,\ 0)=\mathrm{MAX}[^{+4}m=-4\Sigma F_{1,m}(HP(2\cdot I-1+m),0)] \tag{78}$$

(2) Conformith at which the I-th operated end is raised according to Operational Rule 1:

$$A(1,I,\ 1)=\mathrm{MAX}[^{+4}m=-4\Sigma F_{1,m}(-HP(2\cdot I-1+m),0)] \tag{79}$$

(3) Conformity at which the I-th and (I+1)-th operated ends are lowered according to Operational Rule 2:

$$A(2,I,0)=\mathrm{MAX}[^{+4}m=-4\Sigma F_{2,m}(HP(2\cdot I+m),0)] \tag{80}$$

(4) Conformity at which the I-th and (I+1)-th operated ends are raised according to Operational Rule 2:

$$A(2,I,1)=\mathrm{MAX}[^{+4}m=-4\Sigma F_{2,m}(-HP(2\cdot I+m),0)] \quad (81)$$

(5) Conformity at which the I-th operated end is lowered and the (I+1)-th operated end is raised according to Operational Rule 3:

$$A(3,I,0)=\mathrm{MAX}[^{+}m=-4\Sigma F_{3,m}(HP(2\cdot I-1+m),0)] \quad (82)$$

(6) Conformity at which the I-th operated end is raised and the (I+1)-th operated end is lowered according to Operational Rule 3:

$$A(3,I,1)=\mathrm{MAX}[^{+4}m=-4\Sigma F_{3,m}(-HP(2\cdot I-1+m),0)] \quad (83)$$

Each of the above functions is defined as follows:

HP(J), wherein J=1,2, . . . ,2·NS−1, are deviations of half slice profiles which are sequential arrangements of deviations of individual slices and individual half slices in the direction of the width of the paper.

NS is the number of slices which are the operated ends.

$F_{j,m}(x)$ is the membership function for the rule J, wherein J=1,2,3, and wherein "m" represents the relative position which is an integral number within the range of −4 to +4, and "x" represents the deviation of a half slice profile. The term "membership function" is a term used in fuzzy control theory for the value of which is determined by the value of the deviation of a half slice profile HP(m) and corresponds to an evaluation function, such as disclosed in above Japanese Unexamined Patent H5-59685.

A(J,I,0) is the conformity at which the I-th operated end is lowered according to Rule J.

A(J,I,1) is the conformity at which the I-th operated end is raised according to Rule J.

According to the above definitions, $F_{n,m}(x)=F_{n,-m}(-x)$ can be derived from equation (72). With the membership function determined as described above,the system can be more easily and quickly tuned and adjusted as compared to the prior trial-and-error method of tuning and adjusting.

According to the fifth aspect of the invention, wavelet conversion is carried out to obtain an index indicating the degree of localization of deviation of the profile around the measuring point. Then, positional correspondence between the operated end, which is operated at the step response, and the measuring point, is calculated. Accordingly, an optimum interference can be calculated. Also, according to the sixth aspect of the invention, the membership function is calculated according to the positional correspondence obtained according to the first aspect of the invention. Accordingly tuning by trial and error is not necessary, and the profile control of the paper machine can be easily and quickly optimized by the operator.

The foregoing description is illustrative of the principles of the invention. Numerous extensions and modifications thereof would be apparent to the worker skilled in the art. All such extensions and modifications are to be considered to be within the spirit and scope of the invention.

What is claimed is:

1. A system identifier for a paper machine having a plurality of operated ends provided in a direction of a width of a paper and a detected end having a plurality of measuring points located in a direction of the width of said paper and downstream of said plurality of operated ends, for defining which location of said detected end a particular one of said plurality of operated ends corresponds, said system identifier comprising:

means for storing positional correspondence between said plurality of operated ends and detected end based on contraction of said paper;

means for calculating profiles for slices associated with said plurality of operated end by applying measured values at said detected end to said positional correspondence stored in said means for storing positional correspondence;

means for calculating conformity of each of said plurality of operated ends with each detected end by multiplying a profile for a slice by an interference coefficient indicating effect of an operation on an operated end on said detected end;

means for receiving information on conformity of each of said plurality of operated ends with each detected end and for outputting an output slice selection function by performing neural network calculation, wherein self feedback is performed for said plurality of operated ends and lateral inhibition is performed to inhibit mutual interference between neighboring ones of said plurality of operated ends within a predetermined range, thereby to detect a maximum value between neighboring ones of said plurality of operated ends; and means for performing step response at ones of said plurality of operated ends which have maximum values which survived within said range in which mutual interference is inhibited using said output slice selection.

2. The system identifier of claim 1, wherein said means for calculating profiles comprises means for calculating the profiles of said plurality of operated ends and of each of a plurality of virtual half slices located between said plurality of operated ends.

3. The system identifier of claim 1, further comprising:

means for registering ones of said plurality of operated ends at which step response has been performed by said means for performing step response; and means for receiving information on ones of said plurality of operated ends registered in said means for registering and for correcting conformity of said each of said plurality of operated ends to each detected end as calculated by said means for calculating conformity to a smaller value, wherein step responses are obtained from a predetermined number of said plurality of operated ends by said means for receiving information on conformity and said means for performing step response.

4. A system identifier for a paper machine having a plurality of operated ends provided in a direction of a width of a paper and a detected end having a plurality of measured points located in a direction of the width of said paper and downstream of said plurality of operated ends, for defining which location of said detected end a particular one of said plurality of operated ends corresponds, said system identifier comprising:

step response deviation calculation means for obtaining a deviation [B(I,J); J=0,1, . . . ,NM−1] between profiles before and after an operation on said particular operated end;

conversion calculation means for performing wavelet conversion using a peak position variable "n" and a response expanse variable "m" expressed by the following equation:

$$WB(I,m,n)=J\Sigma m-\tfrac{1}{2}\times h(J/m)\times B(I,J+n)$$

on a profile deviation obtained by said step response deviation calculation means wherein h(x) represents a kernel for wavelet conversion localized in a range of an order of a width of said particular operated end about said peak position variable; and positional correspondence determination means for obtaining a pair of said peak position variable and response expanse variable which gives a maximum value (BMAX) of said value WB(I,m,n) calculated by said conversion calculation means.

5. The system indentifier of claim 4, wherein said kernel h(x) of said wavelet conversion is given by the following:

$$h(x)=k_h\times(1-x^2)\times\exp(-x^2/2)$$

wherein $k_h$ is a coefficient.

6. The system identifier of claim 5, wherein summation in said wavelet is within a range of J=−3m to +3m [WB(I,m,n)=+3m$_{j=-}$3mΣm$^{-}$½×h(J/m)×B(I,J+n)]; and wherein said peak position variable and said response expanse variable are in ranges of P1(I)−M≦n≦P1(I)+M, and M≦m≦2M, respectively, wherein P1(I) represents the position of a measuring point of a slice number I determined by overall contraction coefficient and M represents width of measuring points per slice; and further comprising:

noise elimination means for eliminating said maximum value (BMAX) from data for determining peak position variable when said maximum value is smaller than a predetermined threshold in said process of determining positional correspondence.

7. The system identifier of claim 4, further comprising:

output gain correction means for comparing said maximum value (BMAX) obtained by said positional correspondence determination means with an upper threshold and a lower threshold, for decreasing gain of an operational output of said particular operated end when said maximum value is equal to or greater than said upper threshold value and for increasing said gain when said maximum value is equal to or smaller than said lower threshold, thereby correcting said maximum value to reside between said upper threshold and said lower threshold.

8. The system identifier of claim 4, further comprising:

means for calculating an interference coefficient of each of said plurality of operated ends and for each half slice at said plurality of operate ends using a peak position variable which gives said maximum value obtained by said positional correspondence determination means.

9. The system identifier of claim 8, further comprising:

process interference coefficient calculation means for taking an average of said interference coefficients of said each half slice of said plurality of operated ends which have provided step responses; and means for calculating a membership function for operational rules for said plurality of operated ends and for neighboring ones of said plurality of operated ends that define whether they are to be raised or lowered and by what values.

10. A system identifier for a paper machine having a plurality of operated ends provided in a direction of a width of a paper and a detected end having a plurality of measuring points located in a direction of the width of said paper and downstream of said plurality of operated ends, for defining which location of said detected end a particular one of said plurality of operated ends corresponds, said system identifier comprising:

means for storing theoretical positional correspondence based on contraction of said paper;

means for identifying positional correspondence at a step response from a deviation between measured values at said detected end before and after an operation on said particular operated end;

means for identifying a deviation of positional correspondence at said step response from results of calculations by said means for storing theoretical positional correspondence and said means for identifying positional correspondence;

neural net means for receiving deviation of positional correspondence and for outputting said deviation through an intermediate layer and in a quantity determined by number of slices at said plurality of operated ends, and for converting said received deviation using predetermined weight functions and a sigmoid function to obtain a positional correspondence deviation function which provides a minimized error to deviation of positional correspondence; and means for correcting said theoretical positional correspondence using said output positional correspondence deviation function.

* * * * *